US006987495B2

(12) United States Patent
Wakabayashi et al.

(10) Patent No.: US 6,987,495 B2
(45) Date of Patent: Jan. 17, 2006

(54) DISPLAY AND IT'S DRIVING METHOD

(75) Inventors: Toshikazu Wakabayashi, Suita (JP); Masanori Nakatsuji, Ibaraki (JP); Jumpei Hashiguchi, Neyagawa (JP); Kazuo Oohira, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 114 days.

(21) Appl. No.: 10/305,058

(22) Filed: Nov. 27, 2002

(65) Prior Publication Data

US 2003/0193449 A1 Oct. 16, 2003

Related U.S. Application Data

(62) Division of application No. 09/555,926, filed as application No. PCT/JP99/05438 on Jun. 6, 2000, now abandoned.

(30) Foreign Application Priority Data

Oct. 8, 1998 (JP) ..... 10-286589

(51) Int. Cl.
*G09G 3/28* (2006.01)

(52) U.S. Cl. ..... 345/63; 345/66; 313/514

(58) Field of Classification Search ..... 345/60, 345/63, 66, 67; 315/169.1, 169.4; 313/514
See application file for complete search history.

(56) References Cited

U.S. PATENT DOCUMENTS 4,859,910 A 8/1989 Iwakawa et al. ..... 315/169
5,854,540 A * 12/1998 Matsumoto et al. ..... 315/169.1
5,874,932 A 2/1999 Nagaoka et al. ..... 345/60
6,097,358 A * 8/2000 Hirakawa et al. ..... 345/63
6,271,809 B1 8/2001 Kim ..... 345/103

FOREIGN PATENT DOCUMENTS

| | | |
|---|---|---|
| EP | 0254299 | 7/1987 |
| JP | 63-29797 | 2/1988 |
| JP | 4-211294 | 8/1992 |
| JP | 9-305141 | 11/1997 |
| JP | 10-083161 | 3/1998 |
| JP | 10-177364 | 6/1998 |

OTHER PUBLICATIONS

Technical Report of IEICE. EID96–149, SDM96–175 Jan. 1997.

* cited by examiner

*Primary Examiner*—Ricardo Osorio
(74) *Attorney, Agent, or Firm*—Westerman, Hattori Daniels & Adrian, LLP

(57) ABSTRACT

In each of sub-fields on each of lines in a plasma display device, it is judged whether or not all of a plurality of discharge cells on the line or the display cells whose number is not less than a predetermined number do not emit light, and at least one of a voltage applied to a scan electrode and a voltage applied to a sustain electrode on the line are kept at predetermined levels when all of the discharge cells or the discharge cells whose number is not less than the predetermined number do not emit light, or a pulse having the same phase as that of a sustain pulse applied to the sustain electrode 13 is periodically applied in place of a sustain pulse applied to the scan electrode 12 corresponding to the line, to decrease a charge or discharge current as well as to reduce the generation of electromagnetic waves.

6 Claims, 20 Drawing Sheets

DISPLAY AND IT'S DRIVING METHOD

This application is division of prior application Ser. No. 09/555,926 filed Jun. 6, 2000, now abandoned, which is the national stage of International Application No. PCT/JP99/05438, filed Oct. 4, 1999.

TECHNICAL FIELD

The present invention relates to display devices for displaying images by controlling discharges and methods of driving the same.

BACKGROUND ART

Plasma display devices using PDPs (Plasma Display Panels) have the advantage that thinning and larger screens are possible. In the plasma display devices, images are displayed by utilizing light emission in the case of gas discharges.

FIG. 17 is a diagram for explaining a method of driving discharge cells in an AC PDP. As shown in FIG. 17, the surfaces of electrodes 301 and 302 opposite to each other are respectively covered with dielectric layers 303 and 304 in the discharge cell in the AC PDP.

As shown in FIG. 17(*a*), when a voltage lower than a discharge start voltage is applied between the electrodes 301 and 302, no discharges are induced. As shown in FIG. 17(*b*), when a voltage in a pulse shape (a write pulse) higher than the discharge start voltage is applied between the electrodes 301 and 302, discharges are induced. When the discharges are induced, negative charges are stored in a wall surface of the dielectric layer 303 after moving in the direction of the electrode 301, and positive charges are stored in a wall surface of the dielectric layer 304 after moving in the direction of the electrode 302. The charges stored in the wall surface of the dielectric layer 303 or 304 are called "wall charges". Further, a voltage induced by the wall charges is called a "wall voltage".

As shown in FIG. 17(*c*), the negative wall charges are stored in the wall surface of the dielectric layer 301, and the positive wall charges are stored in the wall surface of the dielectric layer 302. In this case, the polarity of the wall voltage is opposite to the polarity of an externally applied voltage. Accordingly, an effective voltage in a discharge space drops as the discharges progress, so that the discharges are automatically stopped.

As shown in FIG. 17(*d*), when the polarity of the externally applied voltage is inverted, the polarity of the wall voltage is the same as the polarity of the externally applied voltage. Accordingly, the effective voltage in the discharge space rises. When the effective voltage at this time exceeds the discharge start voltage, discharges which are opposite in polarity to the discharges shown in FIG. 17(*b*) are induced. Consequently, the positive charges move toward the electrode 301, to neutralize the negative wall charges which have already been stored in the dielectric layer 303. The negative charges move toward the electrode 302, to neutralize the positive wall charges which have already been stored in the dielectric layer 304.

As shown in FIG. 17(*e*), the positive and negative wall charges are respectively stored in the wall surfaces of the dielectric layers 303 and 304. In this case, the polarity of the wall voltage is opposite to the polarity of the externally applied voltage. Accordingly, the effective voltage in the discharge space drops as the discharges progress, so that the discharges are stopped.

Furthermore, as shown in FIG. 17(*f*), when the polarity of the externally applied voltage is inverted, discharges which are opposite in polarity to the discharges shown in FIG. 17(*d*) are induced. Consequently, the negative charges move toward the electrode 301, and the positive charges move toward the electrode 302. The program is then returned to the state shown in FIG. 17(*c*).

After the discharges are thus started once by applying the write pulse higher than the discharge start voltage, the discharges can be continued by inverting the polarity of the externally applied voltage (a sustain pulse) lower than the discharge start voltage using the function of the wall charges. To start discharges by applying a write pulse is called address discharges, and to continue discharges by applying sustain pulses which are alternately inverted from each other is called sustain discharges.

As shown in FIG. 17(*g*), it is possible to cause the wall charges stored in the wall surface of the dielectric layer 303 or 304 by applying an erasure pulse which is opposite in polarity to the wall voltage between the electrodes 301 and 302 to disappear, to terminate discharges. The pulse width of the erasure pulse is set to a small width such that remaining wall charges can be canceled and the wall charges which are opposite in polarity to the remaining wall charges cannot be newly stored. When the wall charges disappear once, no discharges are induced even if the subsequent sustain pulse is applied, as shown in FIG. 17(*h*).

FIG. 18 is a schematic view mainly showing the configuration of a PDP (Plasma Display Panel) in a conventional plasma display device.

As shown in FIG. 18, a PDP 1 comprises a plurality of address electrodes 11, a plurality of scan electrodes (scanning electrodes) 12, and a plurality of sustain electrodes (maintenance electrodes) 13. The plurality of address electrodes 11 are arranged in the vertical direction on a screen, and the plurality of scan electrodes 12 and the plurality of sustain electrodes 13 are arranged in the horizontal direction on the screen. The plurality of sustain electrodes 13 are connected to one another.

A discharge cell is formed at each of the intersections of the address electrodes 11, the scan electrodes 12 and the sustain electrodes 13. The discharge cell constitutes a pixel on the screen.

An address driver 2 drives the plurality of address electrodes 11 in response to image data. A scan driver 3 successively drives the plurality of scan electrodes 12. A sustain driver 4 together drives the plurality of sustain electrodes 13.

FIG. 19 is a schematic sectional view of a three-electrode surface discharge cell in the AC PDP.

In a discharge cell 100 shown in FIG. 19, a scan electrode 12 and a sustain electrode 13 which are paired with each other are formed in the horizontal direction on a front glass substrate 101. The scan electrode 12 and the sustain electrode 13 are covered with a transparent dielectric layer 102 and a protective layer 103. On the other hand, an address electrode 11 is formed in the vertical direction on a back glass substrate 104 opposite to the front glass substrate 101. A transparent dielectric layer 105 is formed on the address electrode 11. A fluorescent member 106 is applied on the transparent dielectric layer 105.

In the discharge cell 100, a write pulse is applied between the address electrode 11 and the scan electrode 12 so that address discharges are induced between the address electrode 11 and the scan electrode 12. Thereafter, periodical sustain pulses which are alternately inverted from each other are applied between the scan electrode 12 and the sustain electrode 13 so that sustain discharges are induced between the scan electrode 12 and the sustain electrode 13.

An ADS (Address and Display period Separated) system is used as gray scale expression in the AC PDP. FIG. 20 is a diagram for explaining the ADS system. The vertical axis in FIG. 20 indicates the scanning direction of the scan electrodes (the vertical scanning direction) corresponding to the first line to the m-th line, and the horizontal axis indicates the time.

In the ADS system, one field (1/60 seconds=16.67 ms) is divided into a plurality of sub-fields on a time basis. For example, when 256 gray scale expression is made by eight bits, one field is divided into eight sub-fields. Each of the sub-fields is separated into an address period during which address discharges for selecting cells which are to be turned on are induced and a sustain period during which sustain discharges for display are induced.

In the example shown in FIG. 20, one field is divided into four sub-fields SF1, SF2, SF3, and SF4 on a time basis. The sub-field SF1 is separated into an address period AD1 and a sustain period SUS1, the sub-field SF2 is separated into an address period AD2 and a sustain period SUS2, the sub-field SF3 is separated into an address period AD3 and a sustain period SUS3, and the sub-field SF4 is separated into an address period AD4 and a sustain period SUS4.

In the ADS system, scanning by address discharges is performed on the whole surface of the PDP from the first line to the m-th line in each of the sub-fields. When the address discharges on the whole surface are terminated, sustain discharges are induced. That is, the sustain period is set in a period excluding the address period. Therefore, the ratio of the sustain period occupied in one field is decreased to approximately 30%, so that there is a limit to luminance improvement.

In order to increase the luminance of the PDP, therefore, an address-while-display scheme (TECHNICAL REPORT OF IEICE.EID96-71, ED96-149, SDM96-175 (1997–01), PP.19–24) is proposed. FIG. 21 is a diagram for explaining the address-while-display scheme. The vertical axis in FIG. 21 indicates the scanning direction of the scan electrodes (the vertical scanning direction) corresponding to the first line to the m-th line, and the horizontal axis indicates the time.

In the address-while-display scheme, sustain discharges are started subsequently to address discharges for each of the lines. In the example shown in FIG. 21, one field is divided into four sub-fields SF1, SF2, SF3, and SF4. The sub-fields SF1 to SF4 respectively include address periods AD1 to AD4 and sustain periods SUS1 to SUS4.

The sustain periods SUS1 to SUS4 are set subsequently to the address periods AD1 to AD4 for each line. Therefore, almost all of one field is a sustain period, which allows luminance improvement.

FIG. 22 is a timing chart showing a voltage for driving each electrode by a conventional address-while-display scheme. In FIG. 22, voltages for driving a sustain electrode 13, scan electrodes 12 corresponding to the n-th line to the (n+3)-th line, and an address electrode 11, where n is an arbitrary integer.

In FIG. 22, sustain pulses Psu are applied to the sustain electrode 13 in a predetermined period. In an address period, a write pulse Pw is applied to the scan electrode 12. Write pulses Pwa are applied to the address electrode 11 in synchronization with the write pulse Pw. The on-off of the write pulses Pwa applied to the address electrode 11 is controlled depending on each of pixels composing a displayed image. When the write pulse Pw and the write pulses Pwa are simultaneously applied, address discharges are induced in a discharge cell at the intersection of the scan electrode 12 and the address electrode 11, so that the discharge cell is turned on.

In a sustain period after the address period, sustain pulses (maintenance pulses) Pse are applied to the scan electrode 12 in a predetermined period. The phase of the sustain pulses Psc applied to the scan electrode 12 is shifted 180° from the phase of the sustain pulses Psu applied to the sustain electrode 13. In this case, sustain discharges are induced only in the discharge cells which have been turned on by the address discharges.

When each of the sub-fields is terminated, an erase pulse Pe is applied to the scan electrode 12. Consequently, wall charges in each of the discharge cells disappear, so that the sustain discharges are terminated. In a time period elapsed from the time when the erase pulse Pe is applied until the subsequent sub-field is started, suspended pulses Pr are applied to the scan electrode 12 in a predetermined period. A period elapsed from the time when the erase pulse Pe is applied until the subsequent sub-field is started is referred to as a suspended period.

In the above-mentioned conventional address-while-display scheme, the sustain pulses Psu are always applied to the sustain electrode 13 in a predetermined period, and the sustain pulses Psc or the suspended pulses Pr are always applied to the scan electrode 12 in a predetermined period. Accordingly, power consumption is increased by charge or discharge currents in the sustain electrode 13 and the scan electrode 12.

An object of the present invention is to provide a display device in which power consumption is reduced and a method of driving the same.

DISCLOSURE OF INVENTION

A display device according to an aspect of the present invention comprises a plurality of first electrodes arranged in a first direction; a plurality of second electrodes arranged in the first direction so as to be paired with the plurality of first electrodes respectively; a plurality of third electrodes arranged in a second direction crossing the first direction; a plurality of discharge cells provided at the intersections of the plurality of first electrodes, the plurality of second electrodes, and the plurality of third electrodes; a first voltage applying circuit for periodically applying a first pulse voltage to each of the first electrodes; a second voltage applying circuit for periodically applying, in a light emission period in each of fields set for each of the second electrodes, a second pulse voltage having a phase different from that of the first pulse voltage to the second electrode; and a voltage holding circuit for keeping, when all of the plurality of discharge cells connected to each of the second electrodes or the discharge cells whose number is not less than a predetermined number do not emit light in the light emission period in each of the fields set for the second electrode, the voltage of at least one of the second electrode and the corresponding first electrode at a predetermined level in the light emission period.

In the display device, each of the discharge cells has a three-electrode structure. The first pulse voltage is periodically applied to each of the first electrodes, and the second pulse voltage is periodically applied to the second electrode in the light emission period in each of the fields set for the second electrode. Consequently, sustain discharges are induced between the first electrode and the second electrode.

When all of the plurality of discharge cells connected to each of the second electrodes or the discharge cells whose number is not less than the predetermined number do not emit light in the light emission period in each of the fields set for the second electrode, the voltage of at least one of the second electrode and the corresponding first electrode is kept at the predetermined level in the light emission period. Consequently, a charge or discharge current in each of the first and second electrodes is reduced, and the generation of electromagnetic waves is reduced. As a result, power consumption in the display device is reduced, and electromagnetic interference is prevented from occurring.

The display device may further comprise a third voltage applying circuit for applying a third pulse voltage for selecting the discharge cell to be light-emitted in response to image data in an address period before the light emission period set for each of the second electrodes to the corresponding third electrode. The voltage holding circuit may comprise a judging circuit for judging whether or not all of the plurality of discharge cells connected to each of the second electrodes or the discharge cells whose number is not less than the predetermined number do not emit light in the light emission period in each of the fields set for the second electrode on the basis of the image data.

In this case, in the address period before the light emission period, the third pulse voltage is applied to the third electrode corresponding to the discharge cell to be light-emitted, and the second pulse voltage is applied to the corresponding second electrode. Consequently, discharges are induced in the discharge cell at the intersection of the third electrode to which the third pulse voltage has been applied and the second electrode to which the second pulse voltage has been applied during the address period, and sustain discharges are induced in the light emission period after the address period. Further, it is judged whether or not all of the plurality of discharge cells connected to the second electrode or the discharge cells whose number is not less than the predetermined number do not emit light in the light emission period in each of the fields set for the second electrode on the basis of the image data. When it is judged that all of the discharge cells connected to the second electrode or the discharge cells whose number is not less than the predetermined number do not emit light, therefore, the voltage of at least one of the second electrode and the corresponding first electrode is kept at the predetermined level.

The display device may further comprise a dividing circuit for dividing each of the fields into a plurality of sub-fields on a time basis, and setting the light emission period in each of the sub-fields. The voltage holding circuit may keep, when all of the plurality of discharge cells connected to each of the second electrodes or the discharge cells whose number is not less than the predetermined number do not emit light in the light emission period in each of the sub-fields set for the second electrode by the dividing circuit, the voltage of at least one of the second electrode and the corresponding first electrode at a predetermined level in the light emission period.

In this case, the light emission period in each of the fields is divided into the plurality of sub-fields on a time basis, so that gray scale expression is possible. Further, when all of the plurality of discharge cells connected to the second electrode or the discharge cells whose number is not less than the predetermined number do not emit light in the light emission period in each of the sub-fields, the voltage of at least one of the second electrode and the corresponding first electrode is kept at the predetermined level. Consequently, the charge or discharge current in one of the first and second electrodes is reduced, and the generation of electromagnetic waves is reduced. As a result, power consumption in the display device is reduced, and electromagnetic interference is prevented from occurring.

The voltage holding circuit may keep, when all of the plurality of discharge cells connected to each of the second electrodes or the discharge cells whose number is not less than the predetermined number do not emit light in the light emission period in each of the fields set for the second electrode, the voltage of the second electrode at the predetermined level in the light emission period. In this case, the charge or discharge current in the second electrode is reduced, and the generation of electromagnetic waves is reduced.

The voltage holding circuit may keep, when all of the plurality of discharge cells connected to each of the second electrodes or the discharge cells whose number is not less than the predetermined number do not emit light in the light emission period in each of the fields set for the second electrode, the voltage of the corresponding first electrode at the predetermined level in the light emission period. In this case, the charge or discharge current in the first electrode is reduced, and the generation of electromagnetic waves is reduced.

The voltage holding circuit may respectively keep, when all of the plurality of discharge cells connected to each of the second electrodes or the discharge cells whose number is not less than the predetermined number do not emit light in the light emission period in each of the fields set for the second electrode, the voltages of the second electrode and the corresponding first electrode at the predetermined levels in the light emission period.

In this case, the charge or discharge currents in the first and second electrodes are reduced, and the generation of electromagnetic waves is reduced. As a result, power consumption in the display device is further reduced, and electromagnetic interference is further prevented from occurring.

The voltage holding circuit may keep, when all of the plurality of discharge cells connected to each of the second electrodes or the discharge cells whose number is not less than the predetermined number do not emit light in the light emission period in each of the fields set for the second electrode, the voltages of the second electrode and the corresponding first electrode at the same level in the light emission period. In this case, the charge or discharge currents in the first and second electrodes are sufficiently reduced, and the generation of electromagnetic waves is sufficiently reduced.

The predetermined level may be a ground potential. Each of the plurality of discharge cells may be a three-electrode surface discharge cell constituting a plasma display panel. In this case, power consumption in the plasma display panel is reduced, and electromagnetic interference is prevented from occurring.

A display device according to another aspect of the present invention comprises a plurality of first electrodes arranged in a first direction; a plurality of second electrodes arranged in the first direction so as to be paired with the plurality of first electrodes respectively; a plurality of third electrodes arranged in a second direction crossing the first direction; a plurality of discharge cells provided at the intersections of the plurality of first electrodes, the plurality of second electrodes, and the plurality of third electrodes; a first voltage applying circuit for periodically applying a first pulse voltage to each of the first electrodes; a second voltage applying circuit for periodically applying, in a light emission period in each of fields set for each of the second electrodes, a second pulse voltage having a phase different from that of the first pulse voltage to the second electrode; and a pulse applying circuit for periodically applying, when all of the plurality of discharge cells connected to each of the second electrodes or the discharge cells whose number is not less than a predetermined number do not emit light in the light emission period in each of the fields set for the second electrode, a pulse voltage having the same phase as that of the first pulse voltage in place of the second pulse voltage to the second electrode in the light emission period.

In the display device according to the present invention, each of the discharge cells has a three-electrode structure. The first pulse voltage is periodically applied to each of the first electrodes, and the second pulse voltage is periodically applied to each of the second electrodes in the light emission period in each of the fields set for the second electrode. Consequently, sustain discharges are induces between the first electrode and the second electrode.

When all of the plurality of discharge cells connected to each of the second electrodes or the discharge cells whose number is not less than the predetermined number do not emit light in the light emission period in each of the fields set for the second electrode, the pulse voltage having the same phase as that of the first pulse voltage is periodically applied in place of the second pulse voltage to the second electrode in the light emission period. Consequently, a potential difference between the first electrode and the second electrode is kept constant, so that charge or discharge currents in the first and second electrodes are reduced. As a result, power consumption in the display device is reduced.

The display device may further comprise a third voltage applying circuit for applying a third pulse voltage for selecting the discharge cell to be light-emitted in response to image data in an address period before the light emission period set for each of the second electrodes to the corresponding third electrode. The pulse applying circuit may comprise a judging circuit for judging whether or not all of the plurality of discharge cells connected to each of the second electrodes or the discharge cells whose number is not less than the predetermined number do not emit light in the light emission period in each of the fields set for the second electrode on the basis of the image data.

In this case, the third pulse voltage is applied to the third electrode corresponding to the discharge cell to be light-emitted, and the second pulse voltage is applied to the second electrode. Consequently, discharges are induced in the discharge cell at the intersection of the third electrode to which the third pulse voltage has been applied and the second electrode to which the second pulse voltage has been applied during the address period, so that sustain discharges are induced in the light emission period after the address period. Further, it is judged whether or not all of the plurality of discharge cells connected to each of the second electrodes or the discharge cells whose number is not less than the predetermined number do not emit light in the light emission period in each of the fields set for the second electrode on the basis of the image data. When it is judged that all of the discharge cells connected to the second electrode or the discharge cells whose number is not less than the predetermined number do not emit light, therefore, the pulse voltage having the same phase as that of the first pulse voltage is periodically applied in place of the second pulse voltage to the second electrode.

The display device may further comprise a dividing circuit for dividing each of the fields into a plurality of sub-fields on a time basis, and setting the light emission period in each of the sub-fields. The pulse applying circuit may periodically apply, when all of the plurality of discharge cells connected to each of the second electrodes or the discharge cells whose number is not less than the predetermined number do not emit light in the light emission period in each of the sub-fields set for the second electrode by the dividing circuit, a pulse voltage having the same phase as that of the first pulse voltage in place of the second pulse voltage to the second electrode in the light emission period.

In this case, the light emission period in each of the fields is divided into the plurality of sub-fields on a time basis, so that gray scale expression is possible. Further, when all of the plurality of discharge cells connected to the second electrode or the discharge cells whose number is not less than the predetermined number do not emit light in the light emission period in each of the sub-fields, the pulse voltage having the same phase as that of the first pulse voltage is periodically applied in place of the second pulse voltage to the second electrode. Consequently, a potential difference between the first electrode and the second electrode is kept constant, so that the charge or discharge currents in the first and second electrodes are reduced. As a result, power consumption in the display device is reduced.

Each of the plurality of discharge cells may be a three-electrode surface discharge cell constituting the plasma display panel. In this case, power consumption in the plasma display panel is reduced, and electromagnetic interference is prevented from occurring.

A method of driving a display device according to still another aspect of the present invention is a method of driving a display device comprising a plurality of first electrodes arranged in a first direction, a plurality of second electrodes arranged in the first direction so as to be paired with the plurality of first electrodes respectively, a plurality of third electrodes arranged in a second direction crossing the first direction, and a plurality of discharge cells provided at the intersections of the plurality of first electrodes, the plurality of second electrodes, and the plurality of third electrodes, comprising the steps of periodically applying a first pulse voltage to each of the first electrodes; periodically applying, in a light emission period in each of fields set for each of the second electrodes, a second pulse voltage having a phase different from that of the first pulse voltage to the second electrode; and keeping, when all of the plurality of discharge cells connected to each of the second electrodes or the discharge cells whose number is not less than the predetermined number do not emit light in the light emission period in each of the fields set for the second electrode, the voltage of at least one of the second electrode and the corresponding first electrode at a predetermined level in the light emission period.

In the method of driving the display device, the first pulse voltage is periodically applied to each of the first electrodes, and the second pulse voltage is periodically applied to the second electrode in the light emission period in each of the fields set for the second electrode. Consequently, sustain discharges are induced between the first electrode and the second electrode.

When all of the plurality of discharge cells connected to the second electrode or the discharge cells whose number is not less than the predetermined number do not emit light in the light emission period in each of the fields set for the second electrode, the voltage of at least one of the second electrode and the corresponding first electrode is kept at the predetermined level in the light emission period.

Consequently, a charge or discharge current in at least one of the first and second electrodes is reduced, and the generation of electromagnetic waves is reduced. As a result, power consumption in the display device is reduced, and electromagnetic interference is prevented from occurring.

The method of driving the display device may further comprise the step of applying a third pulse voltage for selecting the discharge cell to be light-emitted in response to image data in an address period before the light emission period set for each of the second electrodes to the corresponding third electrode. The step of keeping the voltage at the predetermined level may comprise the step of judging whether or not all of the plurality of discharge cells connected to each of the second electrodes or the discharge cells whose number is not less than the predetermined number do not emit light in the light emission period in each of the fields set for the second electrode on the basis of the image data.

In this case, in the address period before the light emission period, the third pulse voltage is applied to the third electrode corresponding to the discharge cell to be light-emitted, and the second pulse voltage is applied to the corresponding second electrode. Consequently, discharges are induced in the discharge cell at the intersection of the third electrode to which the third pulse voltage has been applied and the second electrode to which the second pulse voltage has been applied during the address period, and sustain discharges are induced in the light emission period after the address period. Further, it is judged whether or not all of the plurality of discharge cells connected to each of the second electrodes or the discharge cells whose number is not less than the predetermined number do not emit light in the light emission period in each of the fields set for the second electrode on the basis of the image data. When it is judged that all of the discharge cells connected to the second electrode or the discharge cells whose number is not less than the predetermined number do not emit light, therefore, the voltage of at least one of the second electrode and the corresponding first electrode is kept at a predetermined level.

The method of driving the display device may further comprise the step of dividing each of the fields into a plurality of sub-fields on a time basis, and setting the light emission period in each of the sub-fields. The step of keeping the voltage at the predetermined level may comprise the step of keeping, when all of the plurality of discharge cells connected to each of the second electrodes or the discharge cells whose number is not less than the predetermined number do not emit light in the light emission period in each of the sub-fields set for the second electrode, the voltage of at least one of the first electrode and the corresponding second electrode at a predetermined level in the light emission period.

In this case, the light emission period in each of the fields is divided into the plurality of sub-fields on a time basis, so that gray scale expression is possible. Further, when all of the plurality of discharge cells connected to the second electrode or the discharge cells whose number is not less than the predetermined number do not emit light in the light emission period in each of the sub-fields, the voltage of at least one of the second electrode and the corresponding first electrode is kept at the predetermined level. Consequently, the charge or discharge current in one of the first and second electrodes is reduced, and the generation of electromagnetic waves is reduced. As a result, power consumption in the display device is reduced, and electromagnetic interference is prevented from occurring.

The step of keeping the voltage at the predetermined level may further comprise the step of respectively keeping, when all of the plurality of discharge cells connected to each of the second electrodes or the discharge cells whose number is not less than the predetermined number do not emit light in the light emission period in each of the fields set for the second electrode, the voltages of the second electrode and the corresponding first electrode at the predetermined levels in the light emission period. In this case, the charge or discharge currents in the first and second electrodes are reduced, and the generation of electromagnetic waves is reduced. As a result, power consumption in the display device is further reduced, and electromagnetic interference is further prevented from occurring.

A method of driving a display device according to the present invention is a method of driving a display device comprising a plurality of first electrodes arranged in a first direction, a plurality of second electrodes arranged in the first direction so as to be paired with the plurality of first electrodes respectively, a plurality of third electrodes arranged in a second direction crossing the first direction, and a plurality of discharge cells provided at the intersections of the plurality of first electrodes, the plurality of second electrodes, and the plurality of third electrodes, comprising the steps of periodically applying a first pulse voltage to each of the first electrodes; periodically applying, in a light emission period in each of fields set for each of the second electrodes, a second pulse voltage having a phase different from that of the first pulse voltage to the second electrodes; and periodically applying, when all of the plurality of discharge cells connected to each of the second electrodes or the discharge cells whose number is not less than the predetermined number do not emit light in the light emission period in each of the fields set for the second electrode, a pulse voltage having the same phase as that of the first pulse voltage in place of the second pulse voltage to the second electrode in the light emission period.

In the method of driving the display device, the first pulse voltage is periodically applied to each of the first electrodes, and the second pulse voltage is periodically applied to each of the second electrodes in the light emission period in each of the fields set for the second electrode. Consequently, sustain discharges are induced between the first electrode and the second electrode.

When all of the plurality of discharge cells connected to each of the second electrodes or the discharge cells whose number is not less than the predetermined number do not emit light in the light emission period in each of the fields set for the second electrode, the pulse voltage having the same phase as that of the first pulse voltage is periodically applied in place of the second pulse voltage to the second electrode in the light emission period. Consequently, a potential difference between the first electrode and the second electrode is kept constant, so that the charge or discharge currents in the first and second electrodes are reduced. As a result, power consumption in the display device is reduced.

The method of driving the display device may further comprise the step of applying a third pulse voltage for selecting the discharge cell to be light-emitted in response to image data in an address period before the light emission period set for each of the second electrodes to the corresponding third electrode. The step of periodically applying the voltage may comprise the step of judging whether or not all of the plurality of discharge cells connected to each of the second electrodes or the discharge cells whose number is not less than the predetermined number do not emit light in the light emission period in each of the fields set for the second electrode on the basis of the image data.

In this case, in the address period before the light emission period, the third pulse voltage is applied to the third electrode corresponding to the discharge cell to be light-emitted, and the second pulse voltage is applied to the corresponding second electrode. Consequently, discharges are induced in the discharge cell at the intersection of the third electrode to which the third pulse voltage has been applied and the second electrode to which the second pulse voltage has been applied during the address period, and sustain discharges are induced in the light emission period after the address period. Further, it is judged whether or not all of the plurality of discharge cells connected to each of the second electrodes or the discharge cells whose number is not less than the predetermined number do not emit light in the light emission period in each of the fields set for the second electrode on the basis of the image data. When it is judged that all of the discharge cells connected to the second electrode or the discharge cells whose number is not less than the predetermined number do not emit light, therefore, the pulse voltage having the same phase as that of the first pulse voltage is periodically applied in place of the second pulse voltage to the second electrode.

The method of driving the display device may further comprise the step of dividing each of the fields into a plurality of sub-fields on a time basis, and setting the light emission period in each of the sub-fields. The step of periodically applying the voltage may comprise the step of periodically applying, when all of the plurality of discharge cells connected to each of the second electrodes or the discharge cells whose number is not less than the predetermined number do not emit light in the light emission period in each of the sub-fields set for the second electrode, a pulse voltage having the same phase as that of the first pulse voltage in place of the second pulse voltage to the second electrode in the light emission period.

In this case, the light emission period in each of the fields is divided into the plurality of sub-fields on a time bases, so that gray scale expression is possible. Further, when all of the plurality of discharge cells connected to the second electrode or the discharge cells whose number is not less than the predetermined number do not emit light in the light emission period in each of the sub-fields, the pulse voltage having the same phase as that of the first pulse voltage is periodically applied in place of the second pulse voltage to the second electrode. Consequently, a potential difference between the first electrode and the second electrode is kept constant, so that the charge or discharge currents in the first and second electrodes are reduced. As a result, power consumption in the display device is reduced.

BEST MODE FOR CARRYING OUT THE INVENTION

A plasma display device will be described as an example of a display device according to the present invention.

Figure 1:
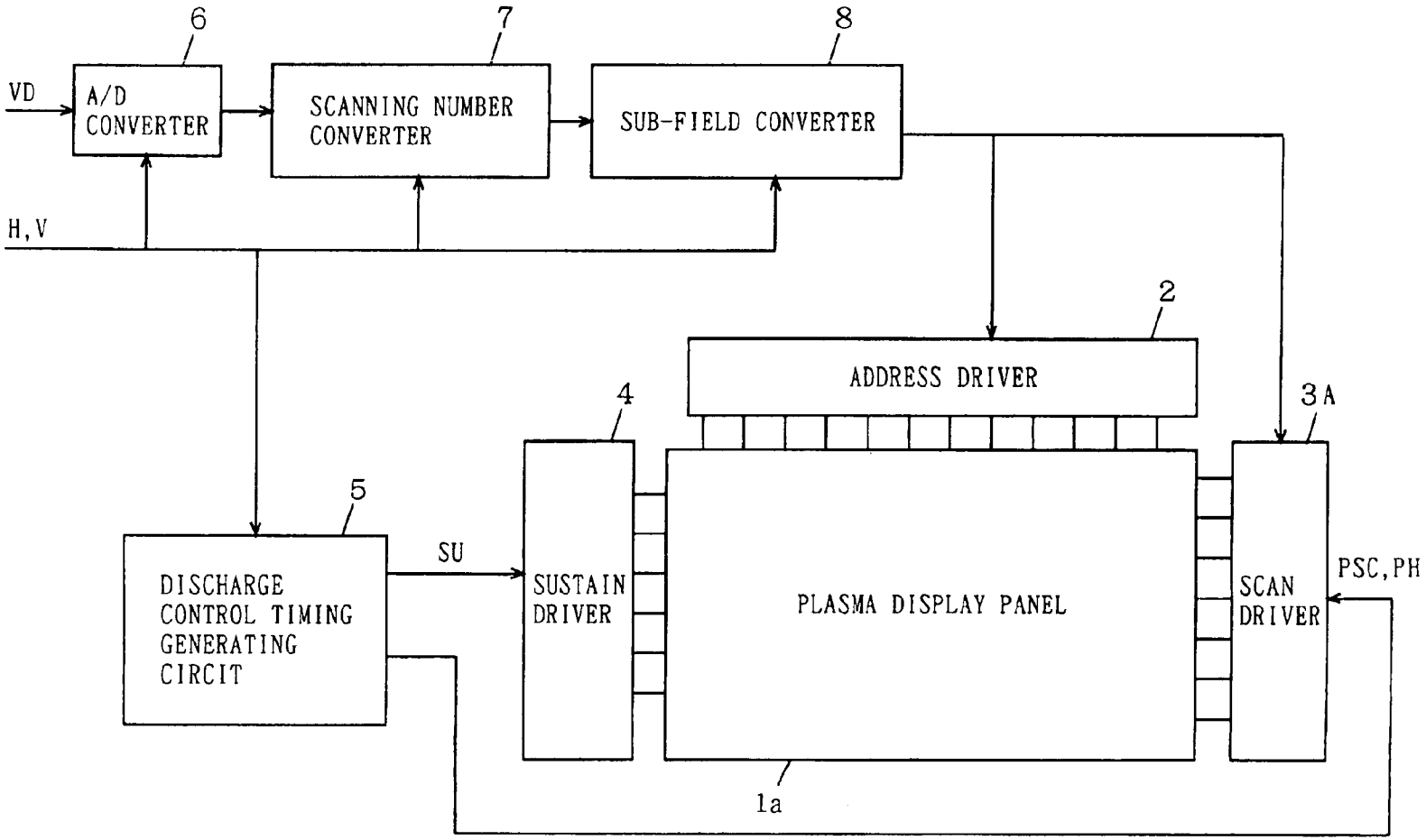
FIG. 1 is a block diagram showing the configuration of a plasma display device according to a first embodiment of the present invention.
Figure 22:
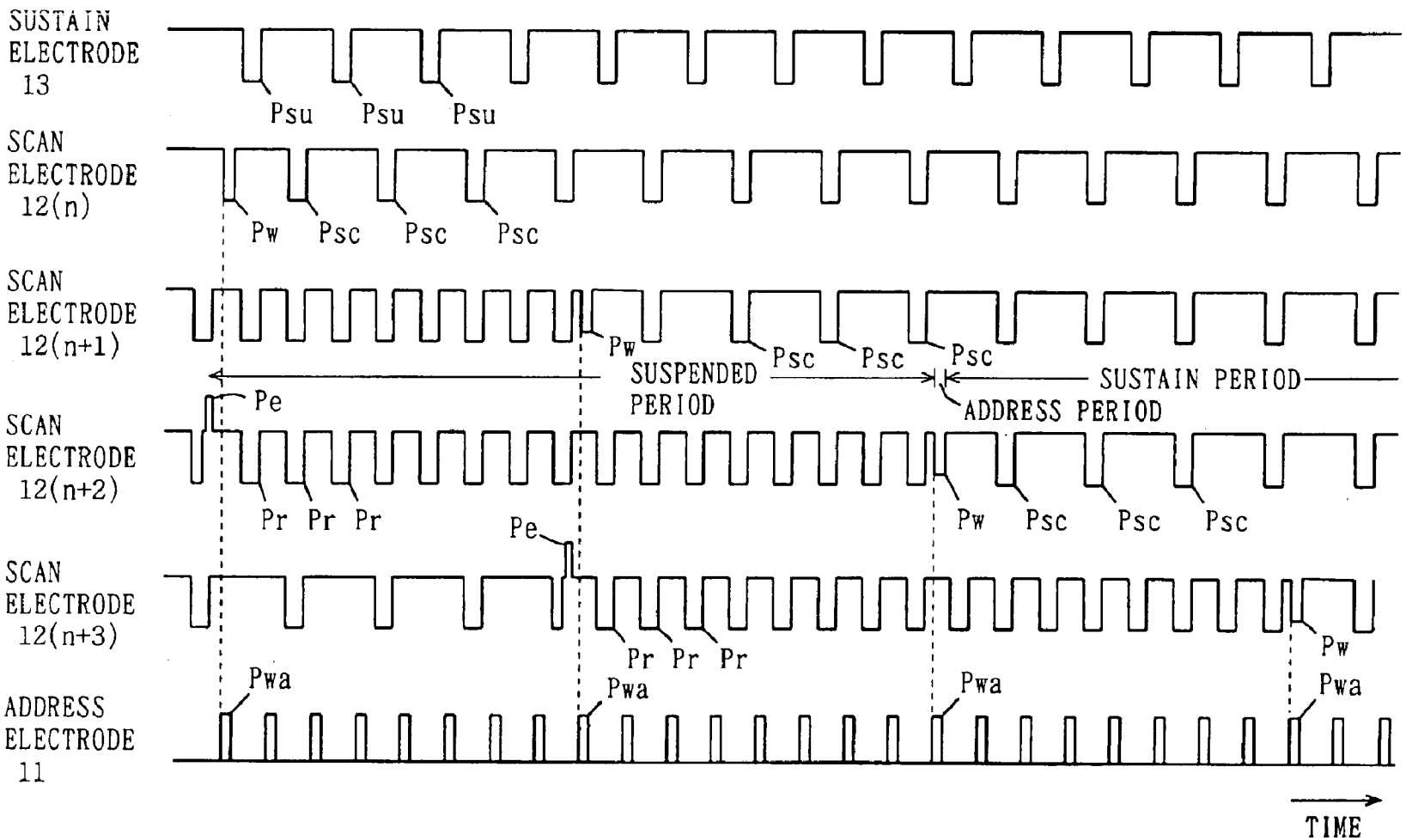
FIG. 22 is a timing chart showing a voltage for driving each electrode by the conventional address-while-display scheme.

FIG. 1 is a block diagram showing the configuration of the plasma display device according to a first embodiment of the present invention. In the plasma display device according to the present embodiment, the address-while-display scheme shown in FIG. 22 is used.

The plasma display device shown in FIG. 1 comprises a PDP (Plasma Display Panel) 1, an address driver 2, a scan driver 3A, a sustain driver 4, a discharge control timing generating circuit 5, an A/D converter (an analog-to-digital converter) 6, a scanning number converter 7, and a sub-field converter 8.

A video signal VD is inputted to the A/D converter 6. A horizontal synchronizing signal H and a vertical synchronizing signal V are fed to the discharge control timing generating circuit 5, the A/D converter 6, the scanning number converter 7, and the sub-field converter 8.

The A/D converter 6 converts the video signal VD into digital image data, and feeds the image data to the scanning number converter 7. The scanning number converter 7 converts the image data into image data on lines whose number corresponds to the number of pixels in the PDP 1, and feeds the image data for each of the lines to the sub-field converter 8. The image data for each of the lines is composed of a plurality of pixel data respectively corresponding to the plurality of pixels for the line. The sub-field converter 8 divides each of the pixel data composing the image data for each of the lines into a plurality of bits corresponding to the plurality of sub-fields, and serially outputs the bits composing each of the pixel data for each of the sub-fields to the address driver 2.

The discharge control timing generating circuit 5 generates discharge control timing signals PSC and SU and a sustain period pulse signal PH using the horizontal synchronizing signal H and the vertical synchronizing signal V as a basis, feeds the discharge control timing signal PSC and the sustain period pulse signal PH to the scan driver 3A, and feeds the discharge control timing signal SU to the sustain driver 4.

Figure 2:
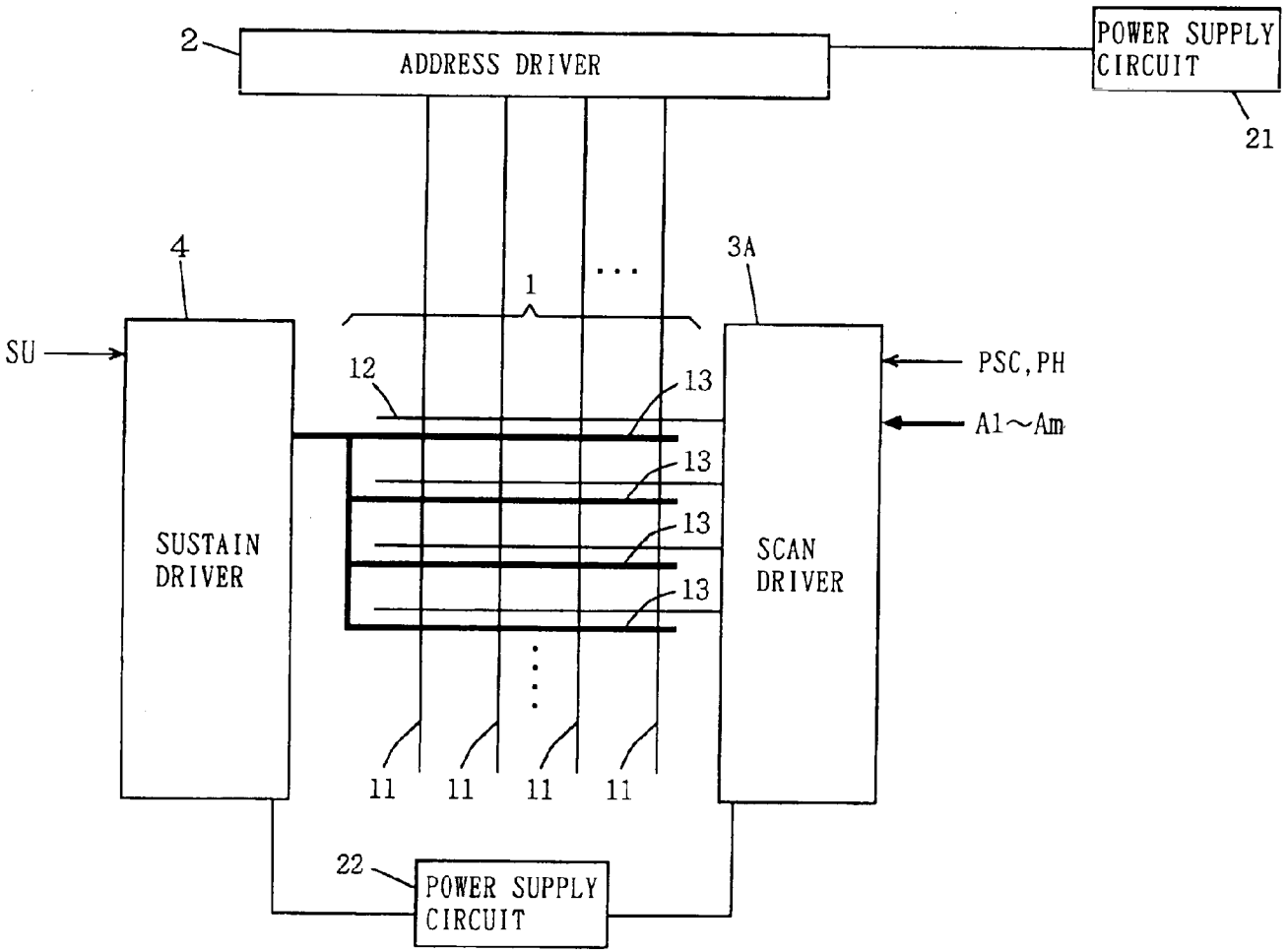
FIG. 2 is a block diagram mainly showing the configuration of a PDP in the plasma display device shown in FIG. 1.

FIG. 2 is a block diagram mainly showing the configuration of the PDP 1 in the plasma display device shown in FIG. 1.

As shown in FIG. 2, the PDP 1 comprises a plurality of address electrodes (data electrodes) 11, a plurality of scan electrodes (scanning electrodes) 12, and a plurality of sustain electrodes (maintenance electrodes) 13. The plurality of address electrodes 11 are arranged in the vertical direction on a screen, and the plurality of scan electrodes 12 and the plurality of sustain electrodes 13 are arranged in the horizontal direction on the screen. The plurality of sustain electrodes 13 are connected to one another.

A discharge cell is formed at each of the intersections of the address electrodes 11, the scan electrodes 12, and the sustain electrodes 13. Each of the discharge cells constitutes the pixel on the screen.

The address driver 2 is connected to a power supply circuit 21. The address driver 2 converts data serially fed for each of sub-fields from the sub-field converter 8 shown in FIG. 1 into parallel data, and drives the plurality of address electrodes 11 on the basis of the parallel data.

The scan driver 3A has a configuration, described later, and the sustain driver 4 comprises an output circuit. The scan driver 3A and the sustain driver 4 are connected to a common power supply circuit 22.

Data A1 to Am corresponding to the plurality of address electrodes 11 for each of the sub-fields on the lines from the sub-field converter 8 shown in FIG. 1 are fed to the scan driver 3A. The number of lines corresponding to the scan electrodes 12 is taken as m. For example, the data A1 indicates whether or not a plurality of discharge cells on the first line emit light in the sub-field, and the data Am indicates whether or not the plurality of discharge cells on the m-th line emit light in the sub-field.

The scan driver 3A successively drives the plurality of scan electrodes 12 on the basis of the discharge control timing signal PSC, the sustain period pulse signal PH, and the data A1 to Am. The sustain driver 4 drives the plurality of sustain electrodes 13 in response to the discharge control timing signal SU.

Figure 3:
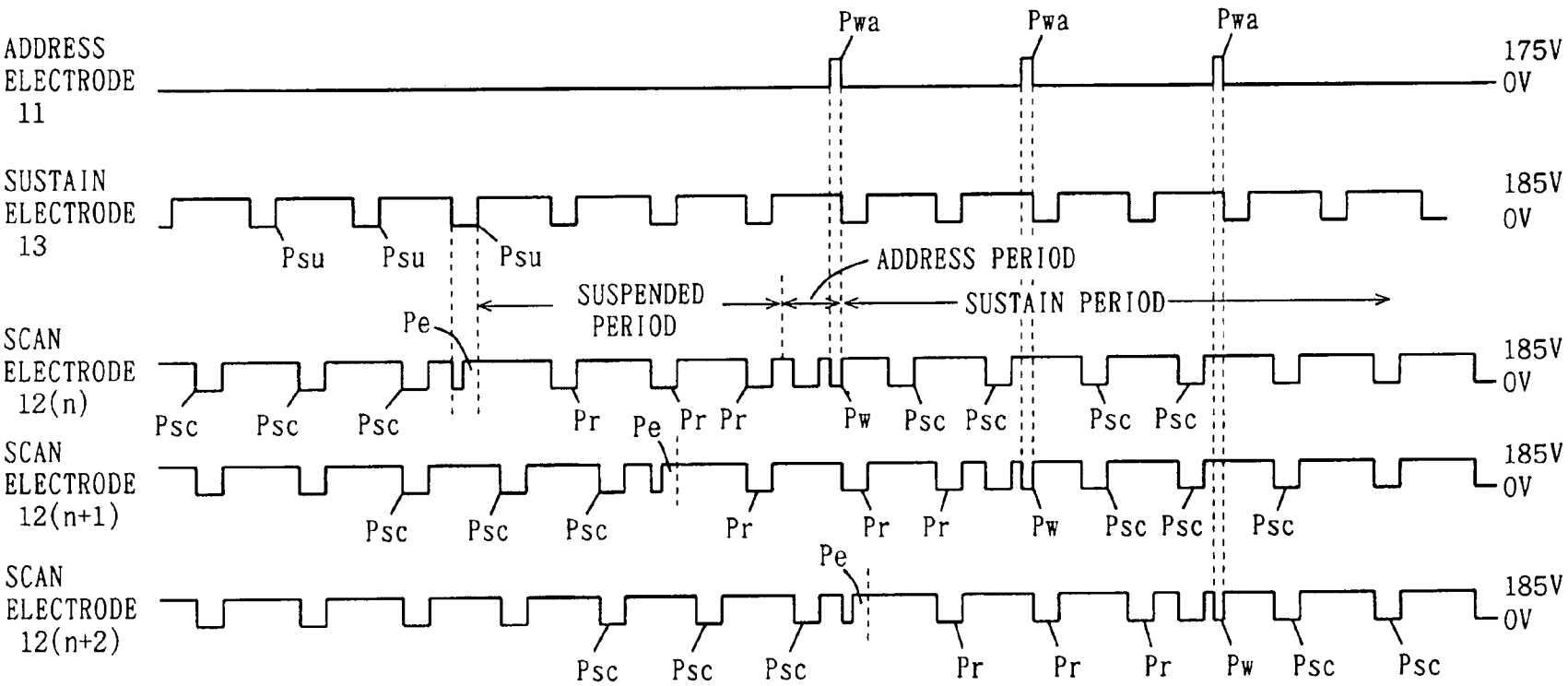
FIG. 3 is a timing chart showing a driving voltage applied to each electrode in the PDP.

FIG. 3 is a timing chart showing a driving voltage applied to each of the electrodes in the PDP. In FIG. 3, the voltages for driving the address electrode 11, the sustain electrode 13, and the scan electrodes 12 corresponding to the n-th line to the (n+2)-th line, where n is an arbitrary integer.

As shown in FIG. 3, sustain pulses Psu are applied to the sustain electrode 13 in a predetermined period. In an address period, a write pulse Pw is applied to the scan electrode 12. Write pulses Pwa are applied to the address electrode 11 in synchronization with the write pulse Pw. The on-off of the write pulses Pwa applied to the address electrode 11 is controlled in response to each of pixels composing an image to be displayed. When the write pulse Pw and the write pulses Pwa are simultaneously applied, address discharges are induced in the discharge cell at the intersection of the scan electrode 12 and the address electrode 11. The discharge cell is turned on.

In a sustain period after the address period, sustain pulses (maintenance pulses) Psc are applied to the scan electrode 12 in a predetermined period. The phase of the sustain pulses Psc applied to the scan electrode 12 is shifted 180° from the phase of the sustain pulses Psu applied to the sustain electrode 13. In this case, sustain discharges are induced only in the discharge cells which have been turned on by the address discharges.

When each of the sub-fields is terminated, an erase pulse Pe is applied to the scan electrode 12. Consequently, wall charges in each of the discharge cells disappear or decrease to such a degree that no sustain discharges are induced, so that the sustain discharges are terminated. In a suspended period (rest period) after application of the erase pulse Pe, suspended pulses (rest pulses) Pr are applied to the scan electrode 12 in a predetermined period. The suspended pulses Pr are the same in phase as the sustain pulses Psu.

Figure 4:
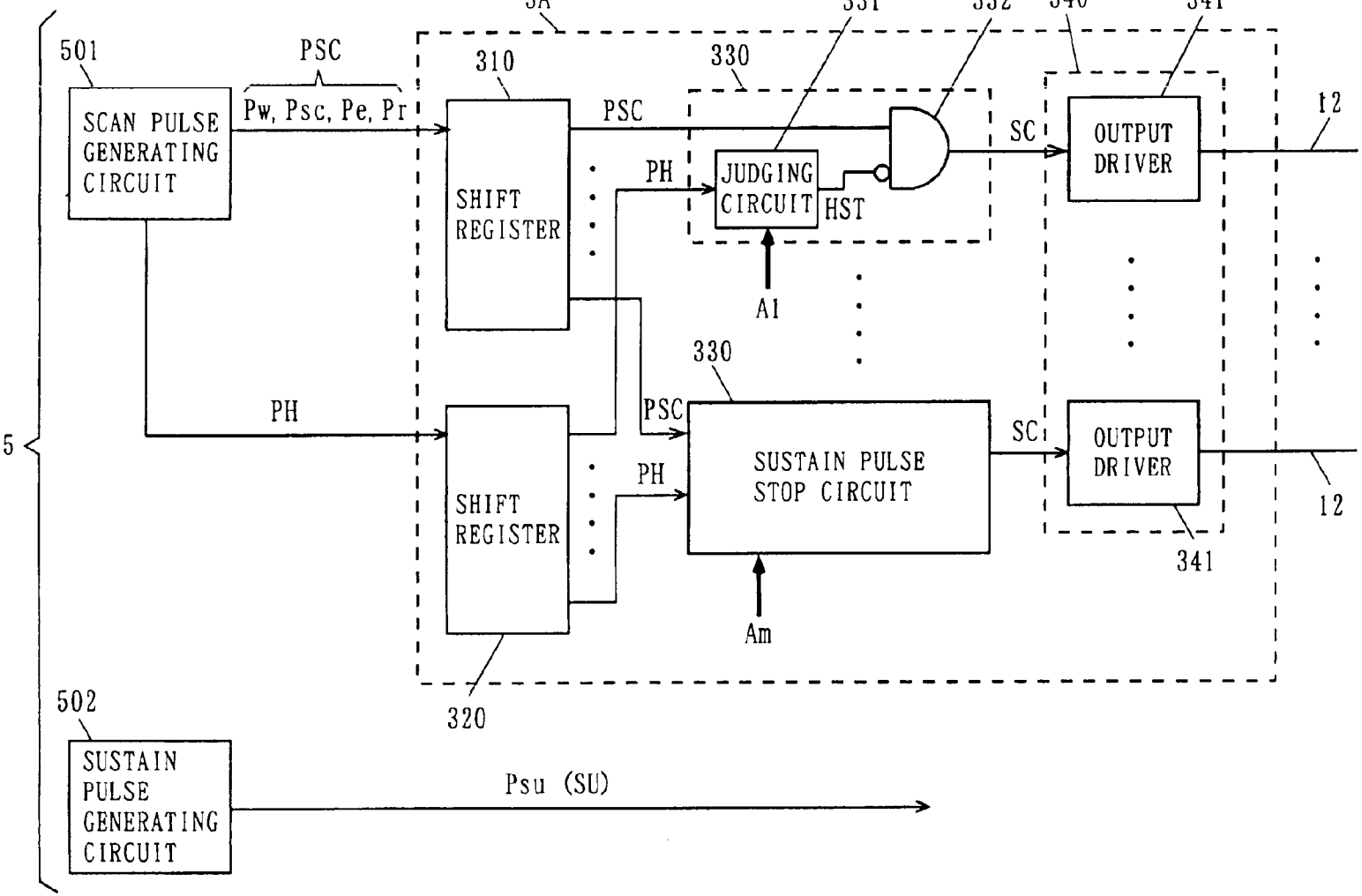
FIG. 4 is a block diagram showing the configurations of a scan driver and a discharge control timing generating circuit shown in FIGS. 1 and 2.
Figure 5:
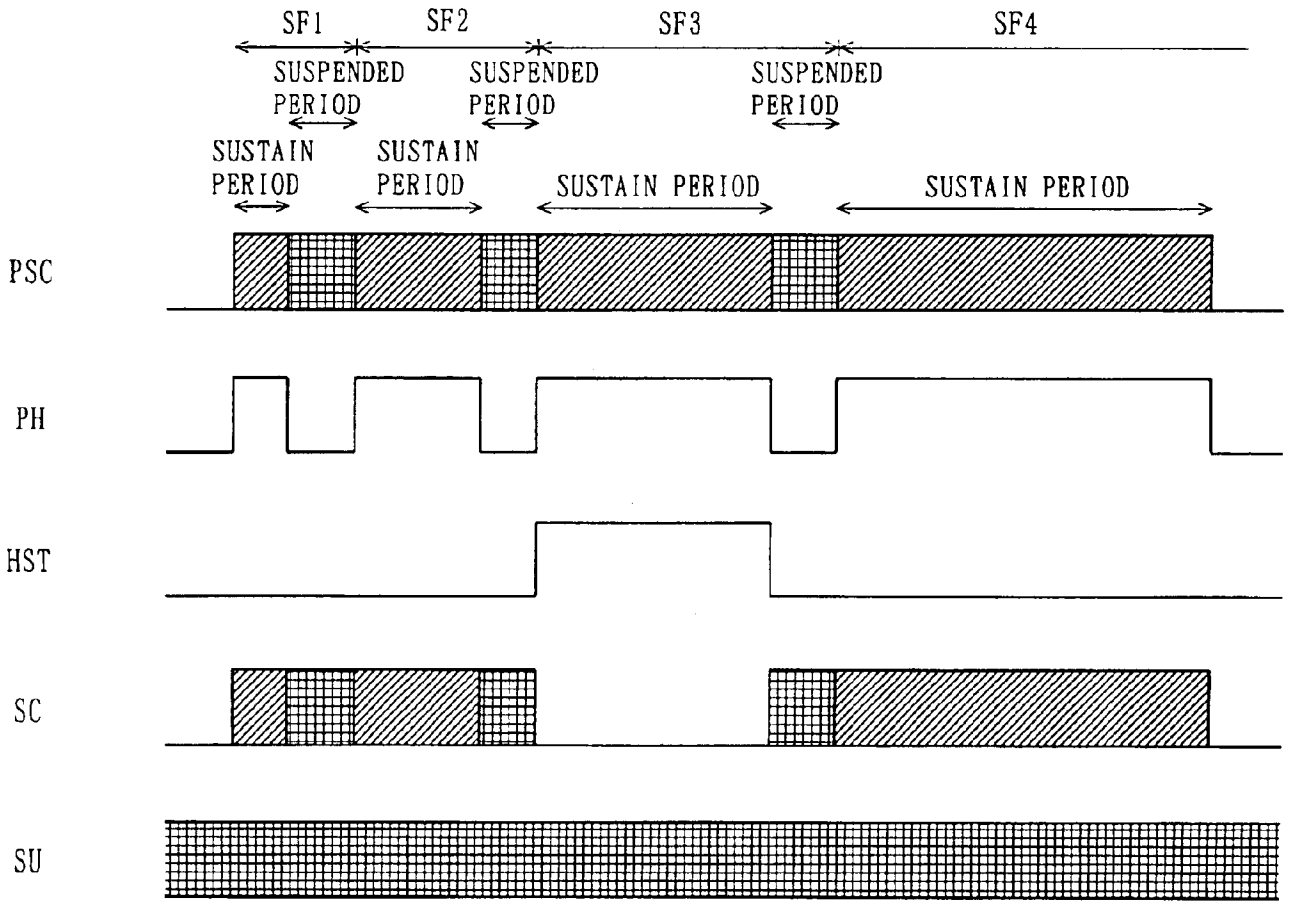
FIG. 5 is a signal waveform diagram showing an example of the operations of the scan driver and the discharge control timing generating circuit shown in FIG. 4.
Figure 6:
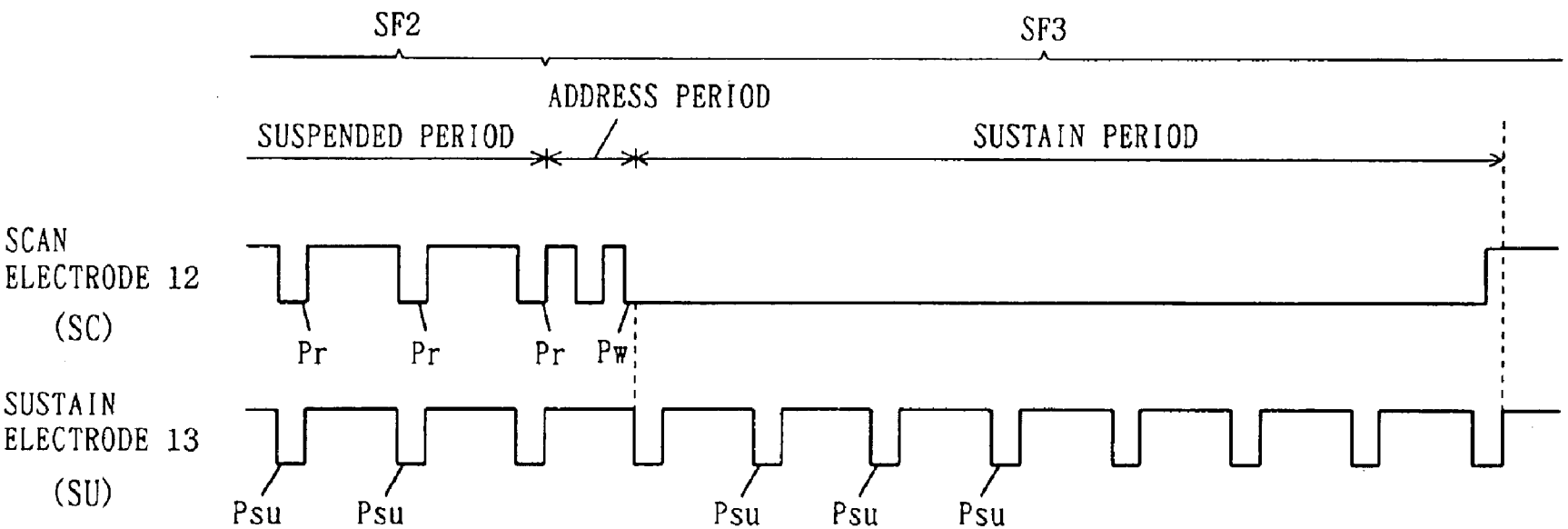
FIG. 6 is a waveform diagram showing voltages for driving a scan electrode and a sustain electrode which correspond to one line.

FIG. 4 is a block diagram showing the configurations of the scan driver and the discharge control timing generating circuit shown in FIGS. 1 and 2. FIG. 5 is a signal waveform diagram showing an example of the operations of the scan driver and the discharge control timing generating circuit shown in FIG. 4. Further, FIG. 6 is a waveform diagram showing voltages for driving the scan electrode and the sustain electrode which correspond to one line.

In FIG. 4, a scan driver 3A comprises two shift registers 310 and 320, a plurality of sustain pulse stop circuits 330 corresponding to the plurality of scan electrodes 12, and an output circuit 340. Each of the shift registers 310 and 320 has a plurality of output terminals corresponding to the plurality of scan electrodes 12. Each of the sustain pulse stop circuits 330 comprises a judging circuit 331 and an AND gate 332. The output circuit 340 comprises a plurality of output drivers 341 respectively connected to the plurality of scan electrodes 12.

A discharge control timing generating circuit 5 comprises a scan pulse generating circuit 501 and a sustain pulse generating circuit 502. The scan pulse generating circuit 501 feeds a discharge control timing signal PSC having a write pulse Pw, a sustain pulse Psc, an erase pulse Pe, and a suspended pulse Pr to the shift register 310 in the scan driver 3A, and feeds a sustain period pulse signal PH representing a sustain period to the shift register 320. The sustain pulse generating circuit 502 feeds a discharge control timing signal SU having a sustain pulse Psu to the sustain driver 4 shown in FIGS. 1 and 2.

The shift register 310 in the scan driver 3A successively feeds the discharge control timing signal PSC to respective one input terminals of the AND gates 332 in the plurality of sustain pulse stop circuits 330 while shifting the discharge control timing signal PSC. Further, the shift register 320 successively feeds the sustain period pulse signal PH to the respective judging circuits 331 in the plurality of sustain pulse stop circuits 330 while shifting the sustain period pulse signal PH.

To the judging circuits 331 in the plurality of sustain pulse stop circuits 330, data A1 to Am for each sub-field on the corresponding lines are respectively fed from the sub-field converter 8 shown in FIG. 1. Each of the data indicates whether or not a plurality of discharge cells on the corresponding line emit light in the sub-field.

The judging circuit 331 judges, on the basis of the sustain period pulse signal PH on the corresponding line and the data for each sub-field on the corresponding line, whether or not all of the discharge cells on the line or the discharge cells whose number is not less than a predetermined number do not emit light in the sub-field, and feeds an inverted signal of a judgment signal HST representing the result of the judgment to the other input terminal of the AND gate 332.

The AND gate 332 feeds a discharge control timing signal SC to the corresponding output driver 341 in the output circuit 340 on the basis of the discharge control timing signal PSC and the judgment signal HST. Consequently, the scan electrode 12 connected to the output driver 341 is driven.

In the present embodiment, the sustain driver 4 and the discharge control timing generating circuit 5 correspond to a first voltage applying circuit, the scan driver 3A and the discharge control timing generating circuit 5 correspond to a second voltage applying circuit, the scan driver 3A corresponds to a voltage holding circuit, and the judging circuit 331 corresponds to a judging circuit. Further, the address driver 2 corresponds to a third voltage applying circuit, and the discharge control timing generating circuit 5 and the sub-field converting circuit 8 correspond to a dividing circuit. Further, the sustain electrode 13 corresponds to a first electrode, the scan electrode 12 corresponds to a second electrode, and the address electrode 11 corresponds to a third electrode.

FIG. 5 illustrates discharge control timing signals PSC, SC, and SU, a sustain period pulse signal PH, and a judgement signal HST which correspond to one line. In FIG. 5, a latticed pattern and a hatched pattern in each of the discharge control timing signals PSC, SC, and SU respectively mean pulses which are shifted 180° from each other.

The phase of the discharge control timing signals PSC and SC and the phase of the discharge control timing signal SU are generally shifted 180° from each other in a sustain period. On the other hand, the phase of the discharge control timing signals PSC and SC and the phase of the discharge control timing signal SU coincide with each other in a suspended period.

The sustain period pulse signal PH enters a high level in the sustain period in each of the sub-fields SF1 to SF4, while entering a low level in the suspended period. The judgment signal HST enters a high level when all of the discharge cells on each of the lines or the discharge cells whose number is not less than the predetermined number do not emit light for each of the sub-fields on the line, while entering a low level in the other case.

In the example shown in FIG. 5, in the sub-field SF3, the judgment signal HST enters a high level. Consequently, no pulse is generated in the discharge control timing signal SC.

As shown in FIG. 6, sustain pulses Psu having a predetermined period are applied to the sustain electrode 13. On the other hand, the voltage of the scan electrode 12 is fixed to zero volt in the sustain period in the sub-field SF3.

It is thus judged whether or not all of the discharge cells on each of the lines or the discharge cells whose number is not less than the predetermined number do not emit light for each of the sub-fields on the line. When all of the discharge cells or the discharge cells whose number is not less than the predetermined number do not emit light, the voltage of the corresponding scan electrode 12 is kept at a predetermined level (zero volt in this example) in the sustain period in the sub-field on the line. Consequently, a charge or discharge current in the scan electrode 12 is reduced, and the generation of electromagnetic waves is reduced. As a result, power consumption in the plasma display device is reduced, and electromagnetic interference is prevented from occurring.

Figure 7:
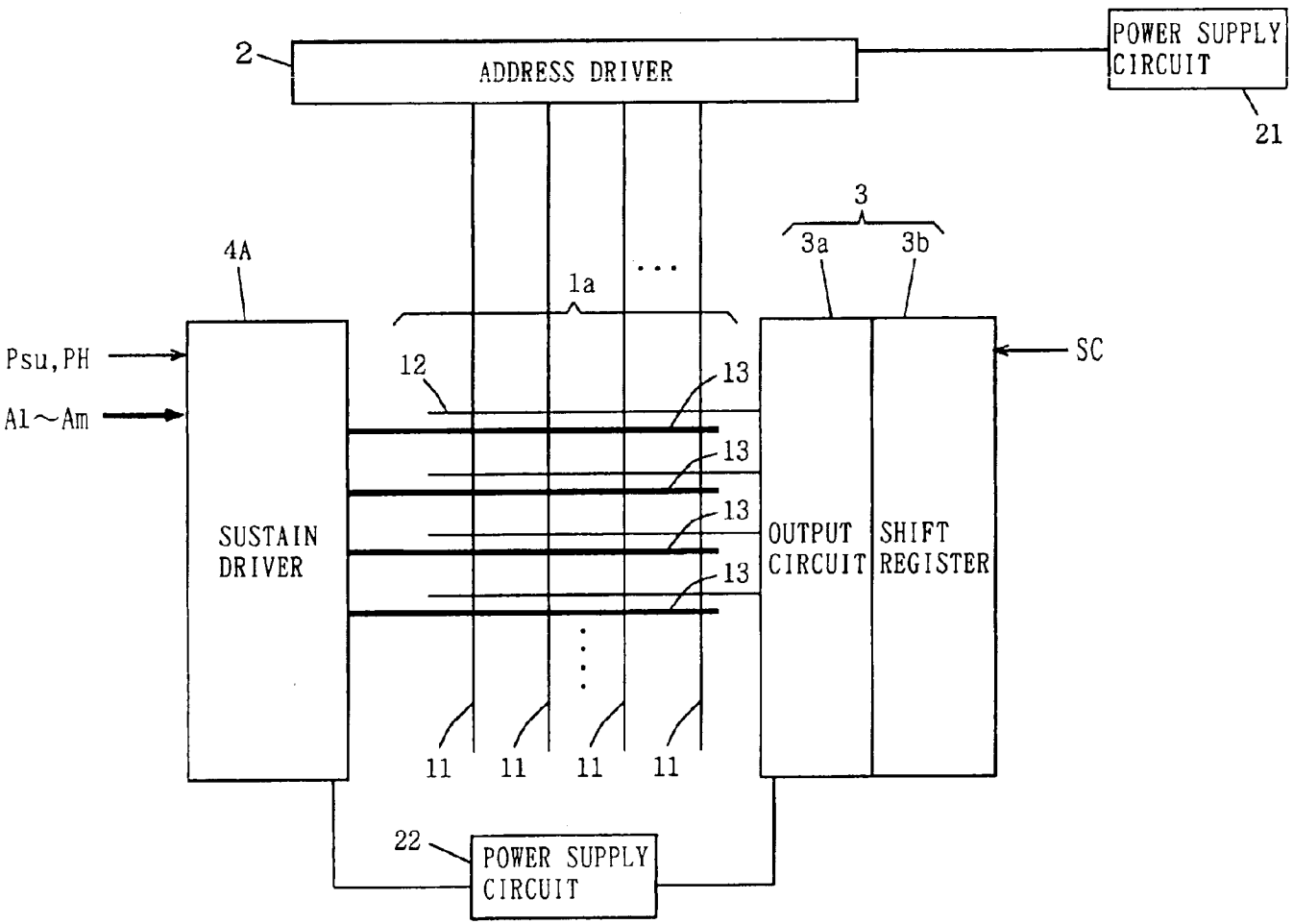
FIG. 7 is a block diagram mainly showing a PDP in a plasma display device according to a second embodiment of the present invention.

FIG. 7 is a block diagram mainly showing the configuration of a PDP in a plasma display device according to a second embodiment of the present invention.

A PDP 1*a* shown in FIG. 7 differs from the PDP 1 shown in FIG. 2 in that a plurality of sustain electrodes 13 are separated from one another for each line. A scan driver 3 is connected to a plurality of scan electrodes 12. A sustain driver 4A is connected to the plurality of sustain electrodes 13.

A discharge control timing signal SC is fed from a discharge control timing generating circuit (see FIG. 1) to the scan driver 3. To the sustain driver 4A, a sustain pulse Psu and a sustain period pulse signal PH are fed from a discharge control timing generating circuit 5, and data A1 to Am corresponding to a plurality of address electrodes 11 are fed for each sub-field on lines from a sub-field converter 8.

The scan driver 3 comprises an output circuit 3*a* and a shift register 3*b*. The shift register 3*b* in the scan driver 3 feeds a discharge control timing signal SC to the output circuit 3*a* while shifting the signal in a vertical scanning direction. The output circuit 3*a* successively drives the plurality of scan electrodes 12 in response to the discharge control timing signal SC fed from the shift register 3*b*.

The sustain driver 4A has a configuration, described later, and successively drivers the plurality of sustain electrodes 13 on the basis of the sustain pulses Psu, the sustain period pulse signal PH, and the data A1 to Am.

Figure 8:
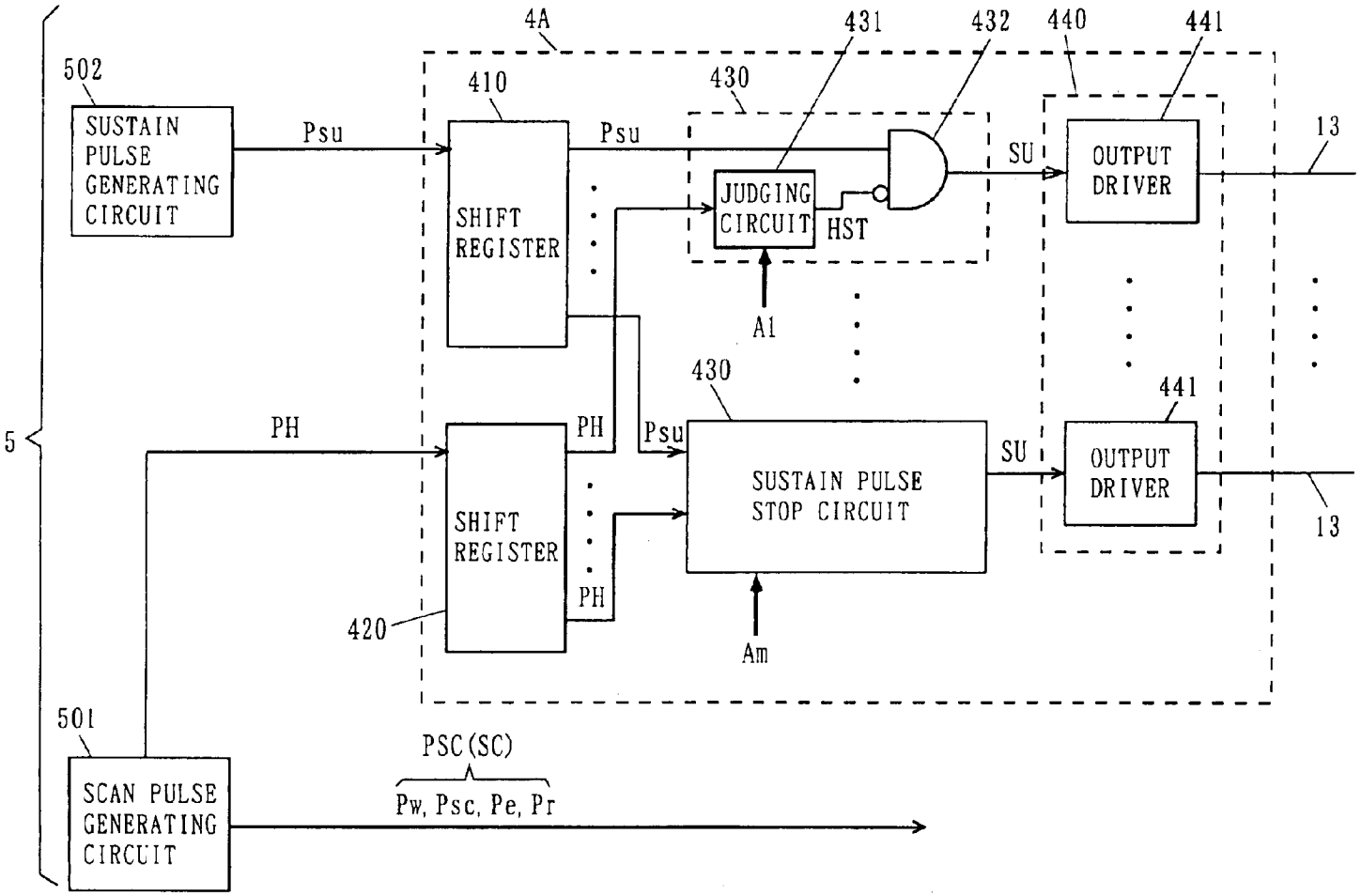
FIG. 8 is a block diagram showing the configurations of a sustain driver and a discharge control timing generating circuit shown in FIG. 7.
Figure 9:
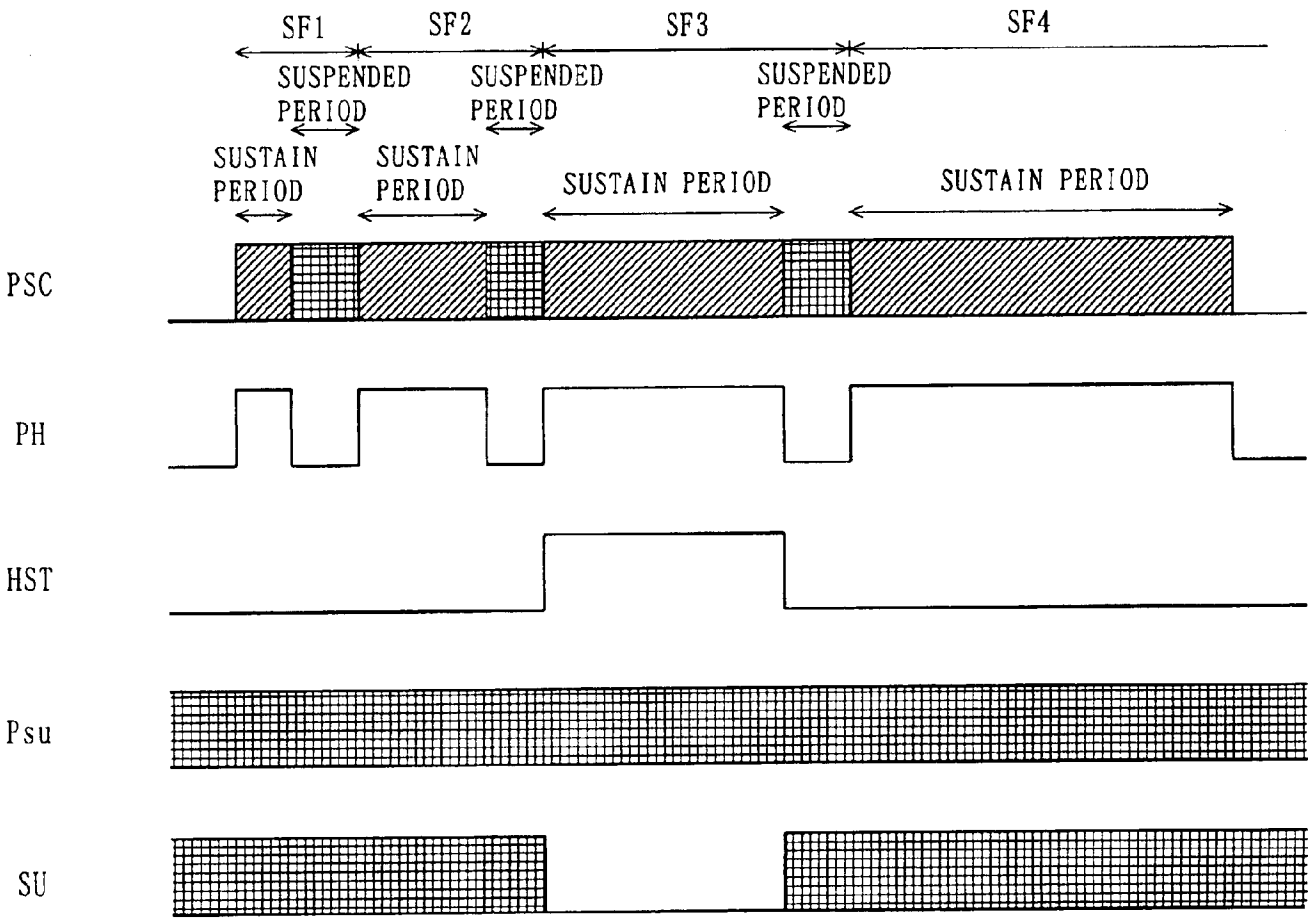
FIG. 9 is a signal waveform diagram showing an example of the operations of the sustain driver and the discharge control timing generating circuit shown in FIG. 8.
Figure 10:
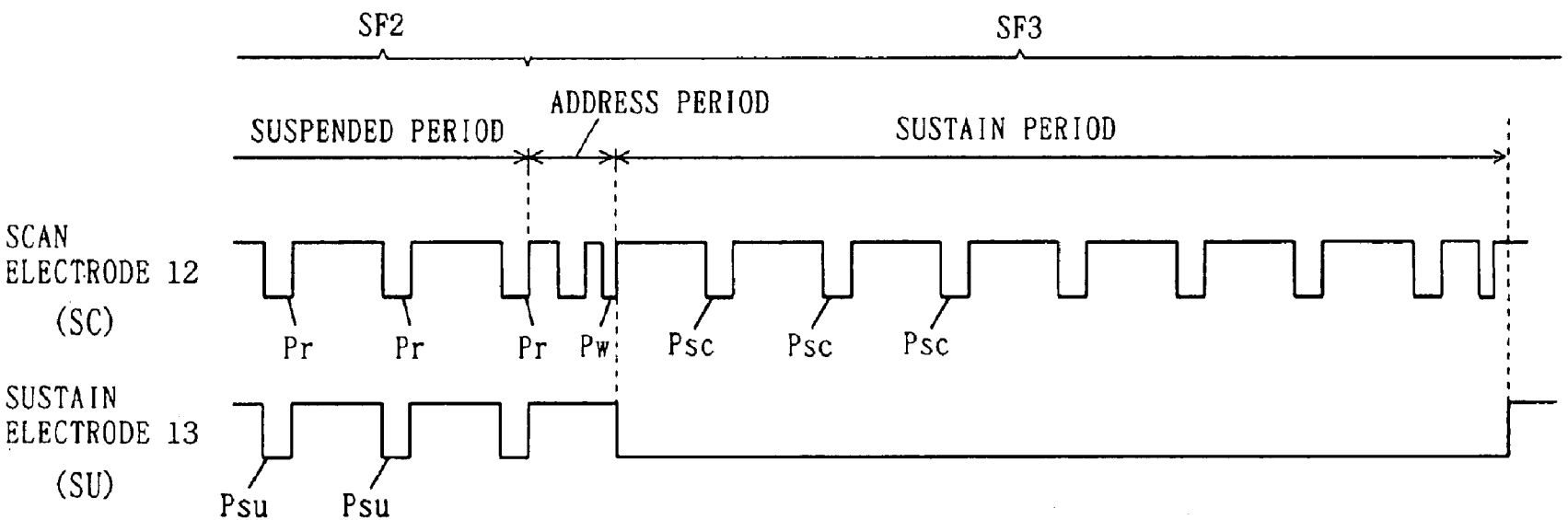
FIG. 10 is a waveform diagram showing voltages for driving a scan electrode and a sustain electrode which correspond to one line.

FIG. 8 is a block diagram showing the configurations of the sustain driver 4A and the discharge control timing generating circuit 5 shown in FIGS. 7. FIG. 9 is a signal waveform diagram showing an example of the operations of the sustain driver 4A and the discharge control timing generating circuit 5 shown in FIG. 8. Further, FIG. 10 is a waveform diagram showing voltages for driving the scan electrode 12 and the sustain electrode 13 which correspond to one line.

In FIG. 8, the sustain driver 4A comprises two shift registers 410 and 420, a plurality of sustain pulse stop circuit 430 corresponding to the plurality of sustain electrodes 13, and an output circuit 440. Each of the shift registers 410 and 420 has a plurality of output terminals corresponding to the plurality of sustain electrodes 13. Each of the sustain pulse stop circuits 430 comprises a judging circuit 431 and an AND gate 432. The output circuit 440 comprises a plurality of output drivers 441 respectively connected to the plurality of sustain electrodes 13.

The discharge control timing generating circuit 5 comprises a scan pulse generating circuit 501 and a sustain pulse generating circuit 502. The scan pulse generating circuit 501 feeds a discharge control timing signal PSC having a write pulse Pw, a sustain pulses Psc, an erase pulse Pe, and a suspended pulse Pr as a discharge control timing signal SC to the shift register 3*b* in the scan driver 3 shown in FIG. 7, and feeds a sustain period pulse signal PH representing a sustain period to the shift register 420 in the sustain driver 4A. The sustain pulse generating circuit 502 feeds a sustain pulse Psu to the shift register 410.

The shift register 410 successively feeds the sustain pulse Psu to respective one input terminals of the AND gates 432 in the plurality of sustain pulse stop circuits 430 while shifting the sustain pulse Psu. Further, the shift register 420 successively feeds the sustain period pulse signal PH to the respective judging circuits 431 in the plurality of sustain pulse stop circuits 430 while shifting the sustain period pulse signal PH.

To the judging circuits 431 in the plurality of sustain pulse stop circuits 430, data A1 to Am for each sub-field on the corresponding lines are respectively fed from the sub-field converter 8 shown in FIG. 1. Each of the data indicates whether or not a plurality of discharge cells on the corresponding line emit light in the sub-field.

The inverting circuit 431 judges, on the basis of the sustain period pulse signal PH on the corresponding line and the data for each sub-field on the corresponding line, whether or not all of the discharge cells or the discharge cells whose number is not less than a predetermined number do not emit light in the sub-field, and feeds an inverted signal of a judgment signal HST representing the result of the judgment to the other input terminal of the AND gate 432.

The AND gate 432 feeds a discharge control timing signal SU to the corresponding output driver 441 in the output circuit 440 on the basis of the sustain pulse Psu and the judgment signal HST. Consequently, the sustain electrode 13 connected to the output driver 441 is driven.

In the present embodiment, the sustain driver 4A corresponds to a voltage holding circuit, and the judging circuit 431 correspond to a judging circuit.

FIG. 9 illustrates discharge control timing signals PSC and SU, a sustain period pulse signal PH, a judgement signal HST, and a sustain pulse Psu which correspond to one line. In FIG. 9, a latticed pattern and a hatched pattern in each of the discharge control timing signals PSC and SU and the sustain pulse Psu mean pulses which are shifted 180° from each other.

The sustain period pulse signal PH enters a high level in a sustain period in each-of sub-fields SF1 to SF4, while entering a low level in a suspended period. The judgment signal HST enters a high level when all of the discharge cells on each of the lines or the discharge cells whose number is not less than the predetermined number do not emit light for each of the sub-fields on the line, while entering a low level in the other case.

The phase of the discharge control timing signal PSC and the phase of the sustain pulse Psu and the discharge control timing signal SU are generally shifted 180° from each other in the sustain period. On the other hand, the phase of the discharge control timing signal PSC and the phase of the sustain pulse Psu and the discharge control timing signal SU coincide with each other in a suspended period.

In the example shown in FIG. 9, in the sub-field SF3, the judgment signal HST enters a high level. Consequently, no pulse is generated in the discharge control timing signal SC.

As shown in FIG. 10, sustain pulses Psu having a predetermined period are applied to the scan electrode 12 in the sustain period in the sub-field SF3. On the other hand, the voltage of the sustain electrode 13 is fixed to zero volt in the sustain period in the sub-field SF3.

It is thus judged whether or not all of the discharge cells on each of the lines or the discharge cells whose number is not less than the predetermined number do not emit light for each of the sub-fields on the line. When all of the discharge cells or the discharge cells whose number is not less than the predetermined number do not emit light, the voltage of the corresponding sustain electrode 13 is kept at a predetermined level (zero volt in this example) in the sustain period in the sub-field on the line. Consequently, a charge or discharge current in the sustain electrode 13 is reduced, and the generation of electromagnetic waves is reduced. As a result, power consumption in the plasma display device is reduced, and electromagnetic interference is prevented from occurring.

Figure 11:
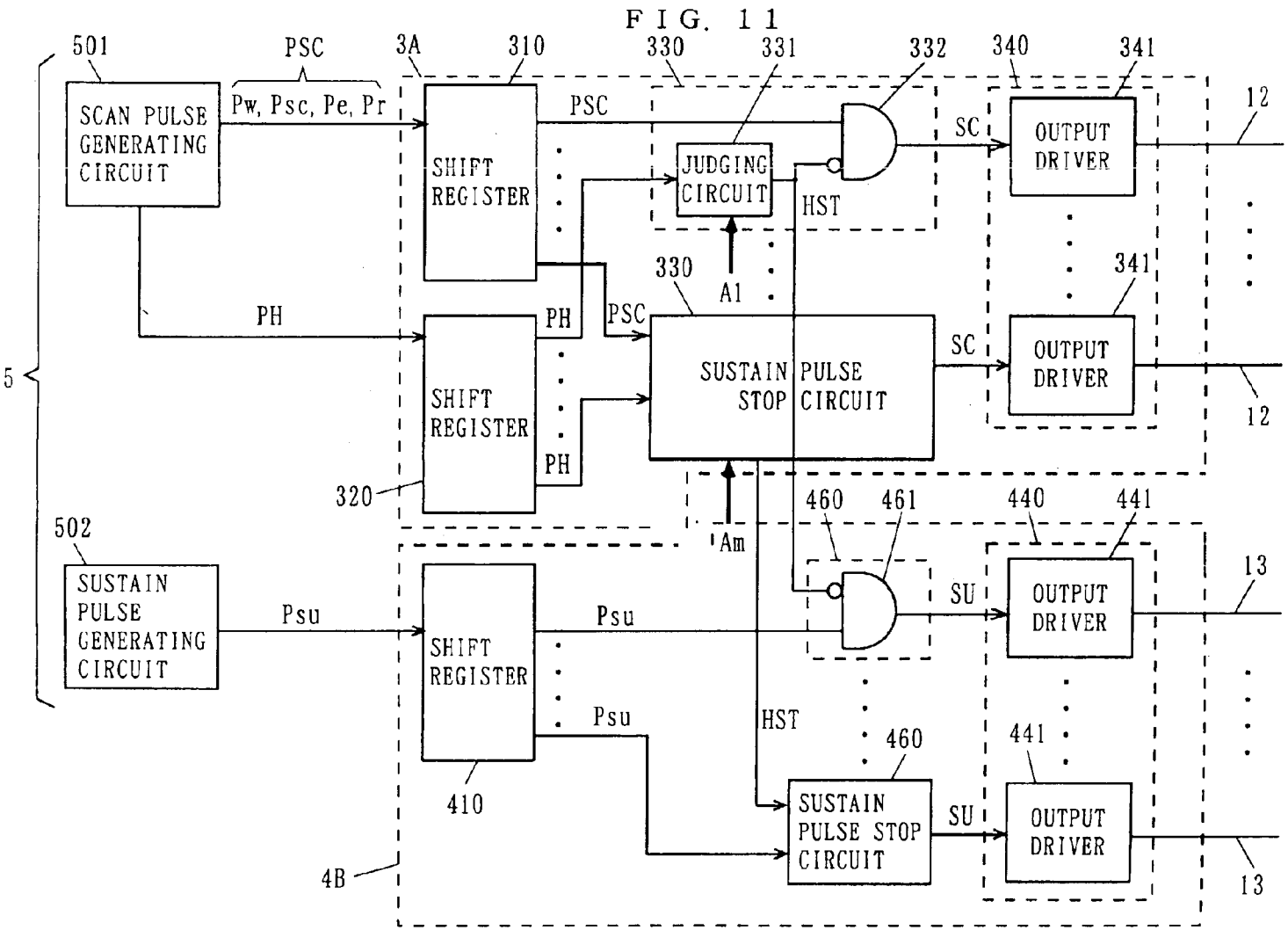
FIG. 11 is a block diagram showing the configurations a scan driver, a sustain driver, and a discharge control timing generating circuit in a plasma display device according to a third embodiment of the present invention.
Figure 12:
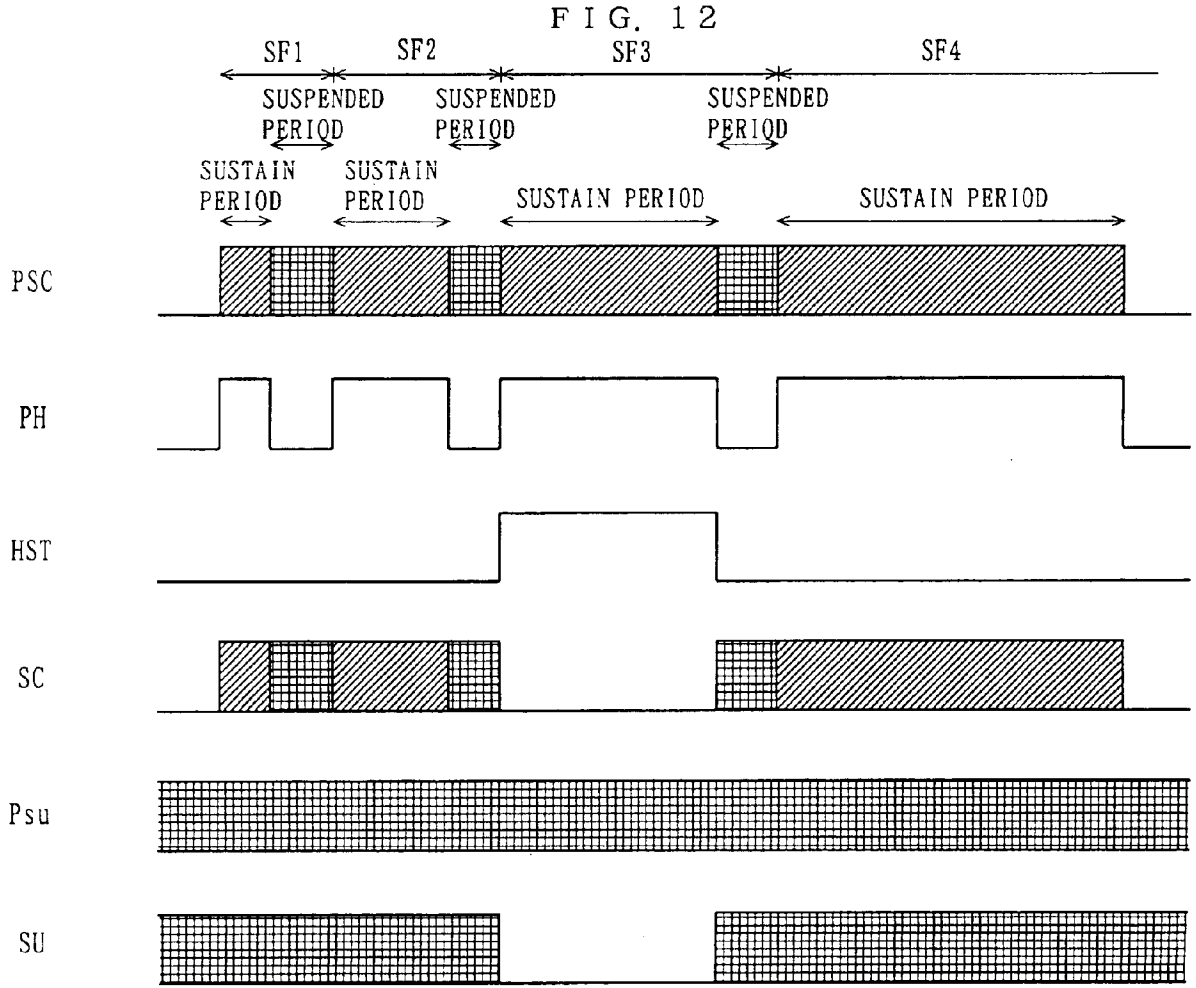
FIG. 12 is a signal waveform diagram showing an example of the operations of the scan driver, the sustain driver, and the discharge control timing generating circuit shown in FIG. 11.
Figure 13:
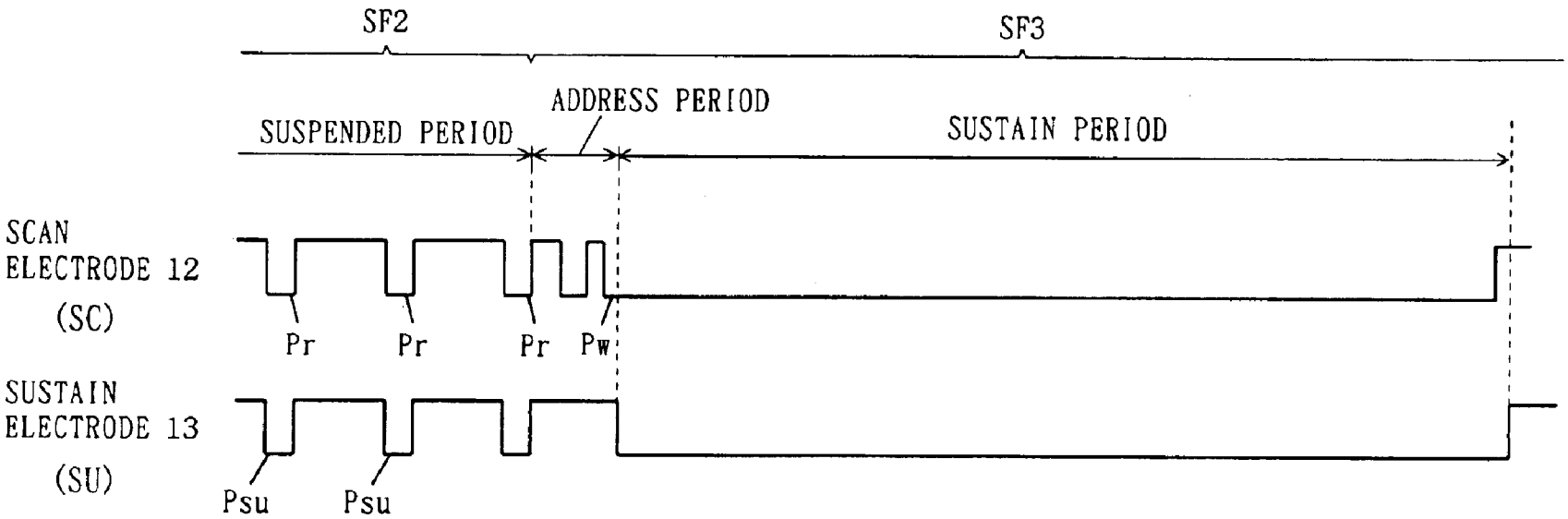
FIG. 13 is a waveform diagram showing voltages for driving a scan electrode and a sustain electrode which correspond to one line.

FIG. 11 is a block diagram mainly showing the configurations of a scan driver, a sustain driver, and a discharge control timing generating circuit in a plasma display device according to a third embodiment of the present invention. FIG. 12 is a signal waveform diagram showing an example of the operations of the scan driver, the sustain driver, and the discharge control timing generating circuit shown in FIG. 11. Further, FIG. 13 is a waveform diagram showing voltages for driving a scan electrode and a sustain electrode which correspond to one line.

In FIG. 11, the configurations and the operations of a scan pulse generating circuit 501 and a scan driver 3A are the same as the configuration of the scan driver 3A shown in FIG. 4. A sustain driver 4B comprises a shift register 410, a plurality of sustain pulse stop circuits 460 corresponding to a plurality of sustain electrodes 13, and an output circuit 440.

The shift register 410 has a plurality of output terminals corresponding to the plurality of sustain electrodes 13. Each of the sustain pulse stop circuits 460 comprises an AND gate 461. The output circuit 440 comprises a plurality of output drivers 441 respectively connected to the plurality of sustain electrodes 13.

The sustain pulse generating circuit 502 feeds a sustain pulse Psu to the shift register 410 in the sustain driver 4B. The shift register 410 successively feeds the sustain pulse Psu to respective one input terminals of the AND gates 461 in the plurality of sustain pulse stop circuits 460 while shifting the sustain pulse Psu. An inverted signal of a judgment signal HST is fed from the judging circuit 331 in the corresponding sustain pulse stop circuit 330 to the other input terminal of the AND gate 461.

The AND gate 461 feeds a discharge control timing signal SU to the corresponding output driver 441 in the output circuit 440 on the basis of the sustain pulse Psu and the judgment signal HST. Consequently, the sustain electrode 13 connected to the output driver 441 is driven.

In the present embodiment, the scan driver 3A and the sustain driver 4B correspond to a voltage holding circuit, and the judging circuit 331 corresponds to a judging circuit.

FIG. 12 illustrates discharge control timing signals PSC, SC, and SU, a sustain period pulse signal PH, a judgement signal HST, and a sustain pulse Psu which correspond to one line. In FIG. 12, a latticed pattern and a hatched pattern in each of the discharge control timing signals PSC, SC, and SU and the sustain pulse Psu respectively mean pulses which are shifted 180° from each other.

The phase of the discharge control timing signals PSC and SC and the phase of the sustain pulse Psu and the discharge control timing signal SU are generally shifted 180° from each other in a sustain period. On the other hand, the phase of the discharge control timing signals PSC and SC and the phase of the sustain pulses Psu and the discharge control timing signal SU coincide with each other in a suspended period.

The sustain period pulse signal PH enters a high level in the sustain period in each of sub-fields SF1 to SF4, while entering a low level in the suspended period. The judgment signal HST enters a high level when all of the discharge cells on each of lines or the discharge cells whose number is not less than a predetermined number do not emit light for each of the sub-fields on the line, while entering a low level in the other case.

In the example shown in FIG. 12, in the sub-field SF3, the judgment signal HST enters a high level. Consequently, no pulse is generated in the discharge control timing signals SC and SU.

As shown in FIG. 13, in the sustain period in the sub-field SF3, the voltages of the scan electrode 12 and the sustain electrode 13 are fixed to zero volt.

It is thus judged whether or not all of the discharge cells on each of the lines or the discharge cells whose number is not less than the predetermined number do not emit light for each of the sub-fields on the line. When all of the discharge cells or the discharge cells whose number is not less than the predetermined number do not emit light, the voltages of the corresponding scan electrode 12 and the corresponding sustain electrode 13 are kept at a predetermined level (zero volt in this example) in the sustain period in the sub-field on the line. Consequently, charge or discharge currents in the scan electrode 12 and the sustain electrode 13 are reduced, and the generation of electromagnetic waves is reduced. As a result, power consumption in the plasma display device is reduced, and electromagnetic interference is prevented from occurring.

Figure 14:
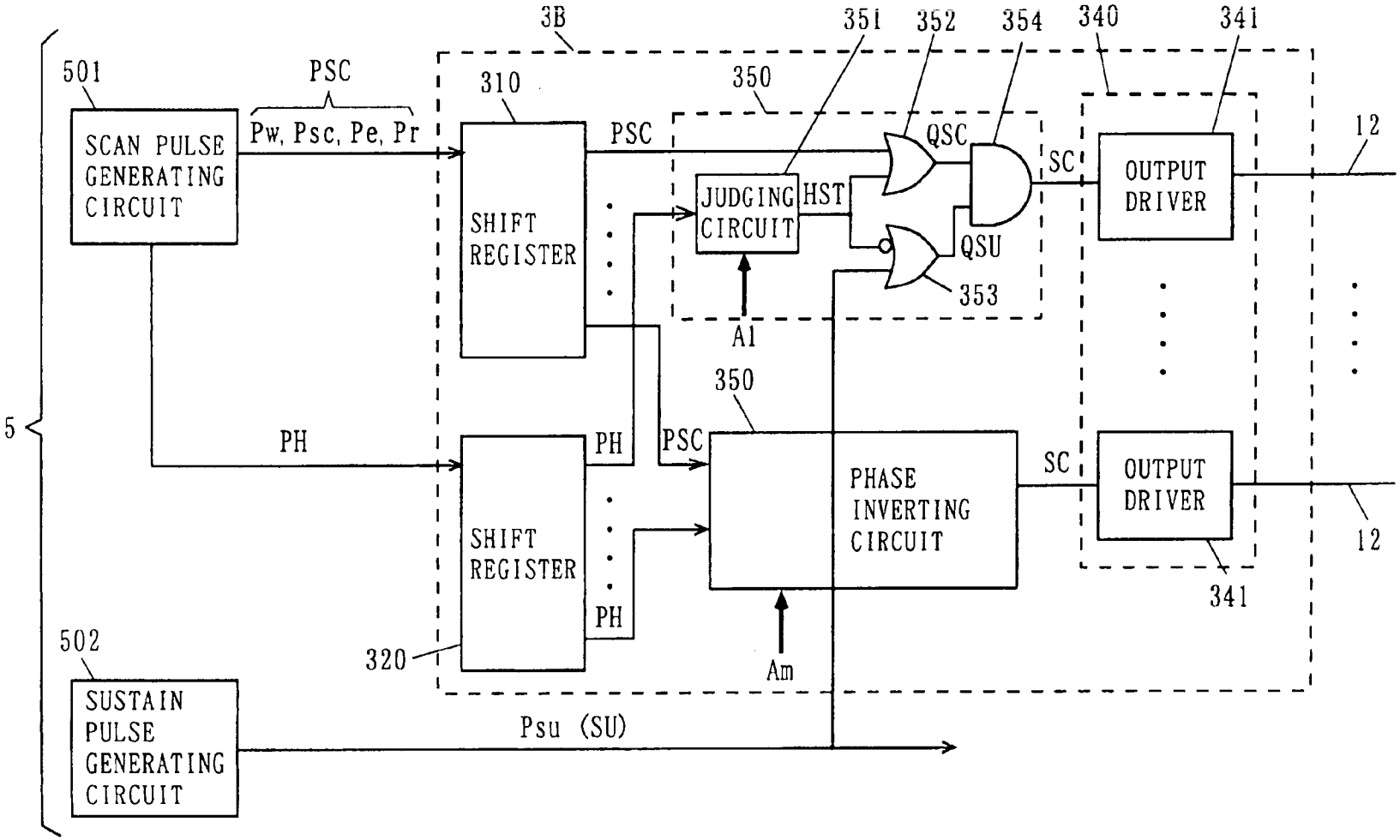
FIG. 14 is a block diagram showing the configurations of a scan driver and a discharge control timing generating circuit in a plasma display device according to a fourth embodiment of the present invention.
Figure 15:
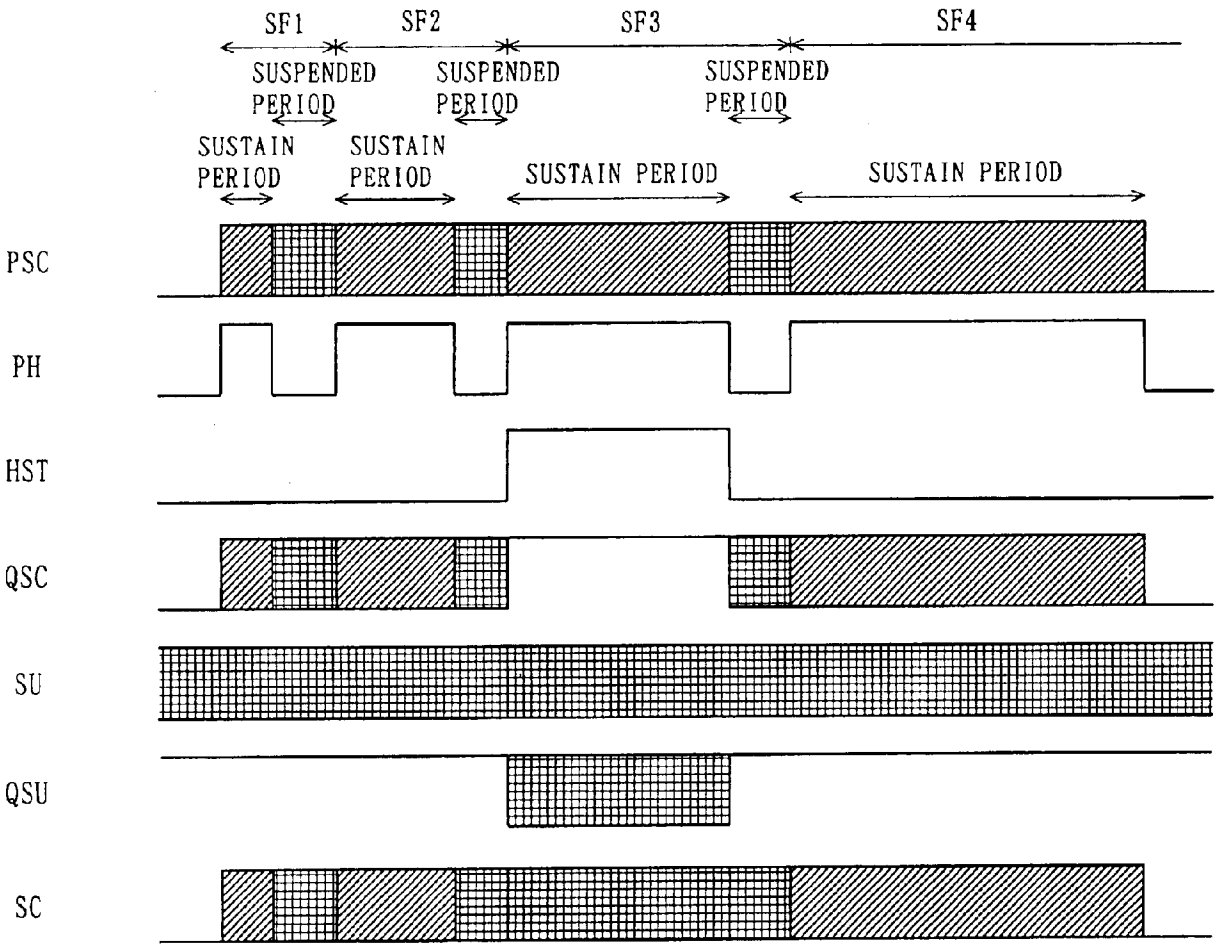
FIG. 15 is a signal waveform diagram showing an example of the operations of the scan driver and the discharge control timing generating circuit shown in FIG. 14.
Figure 16:
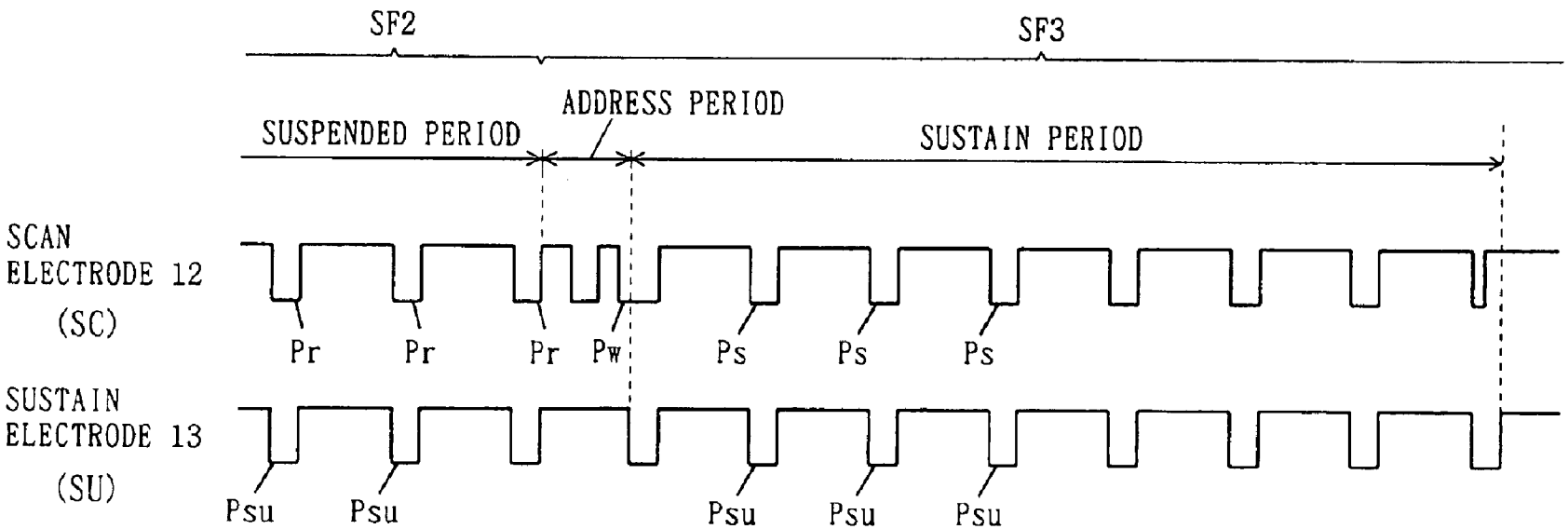
FIG. 16 is a waveform diagram showing voltages for driving a scan electrode and a sustain electrode which correspond to one line.
Figure 17:
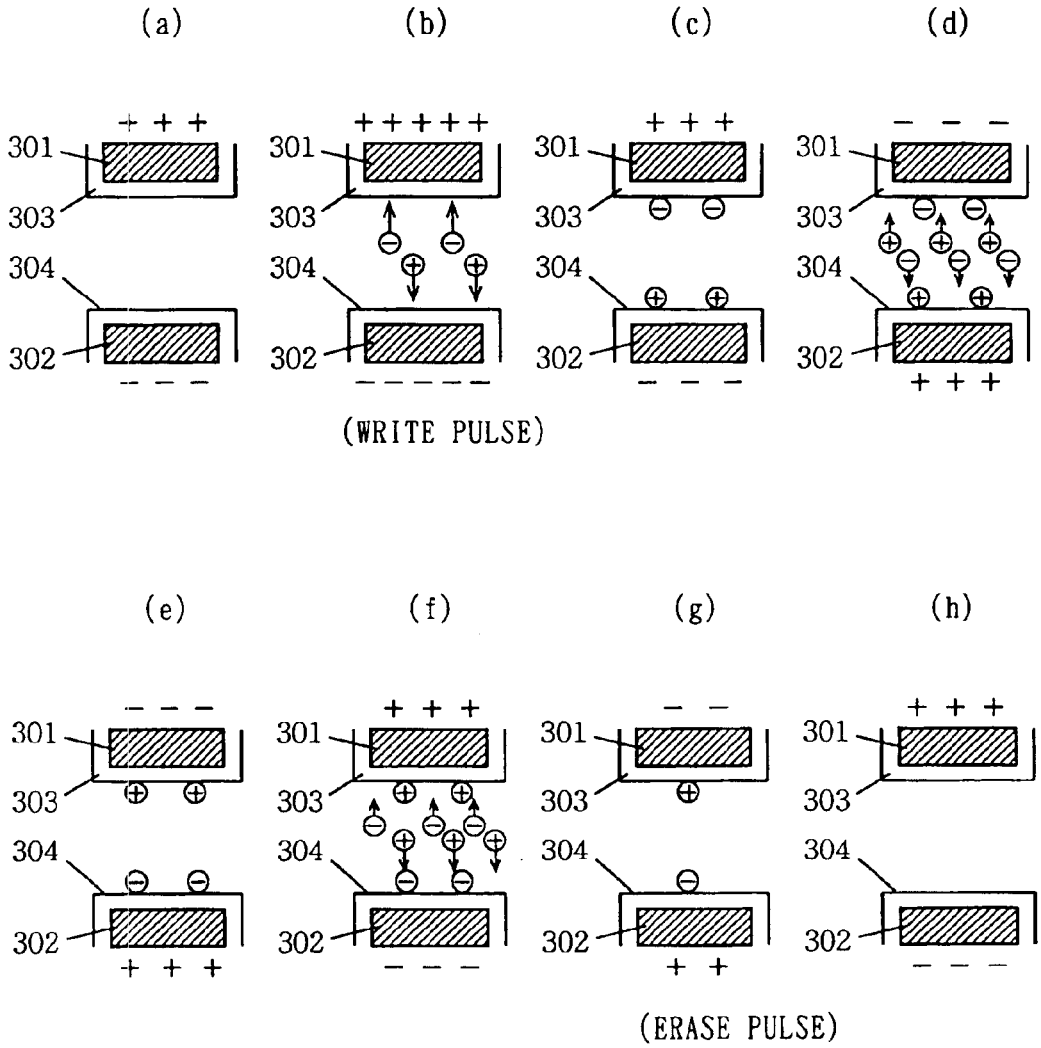
FIG. 17 is a diagram for explaining a method of driving discharge cells in an AC PDP.
Figure 18:
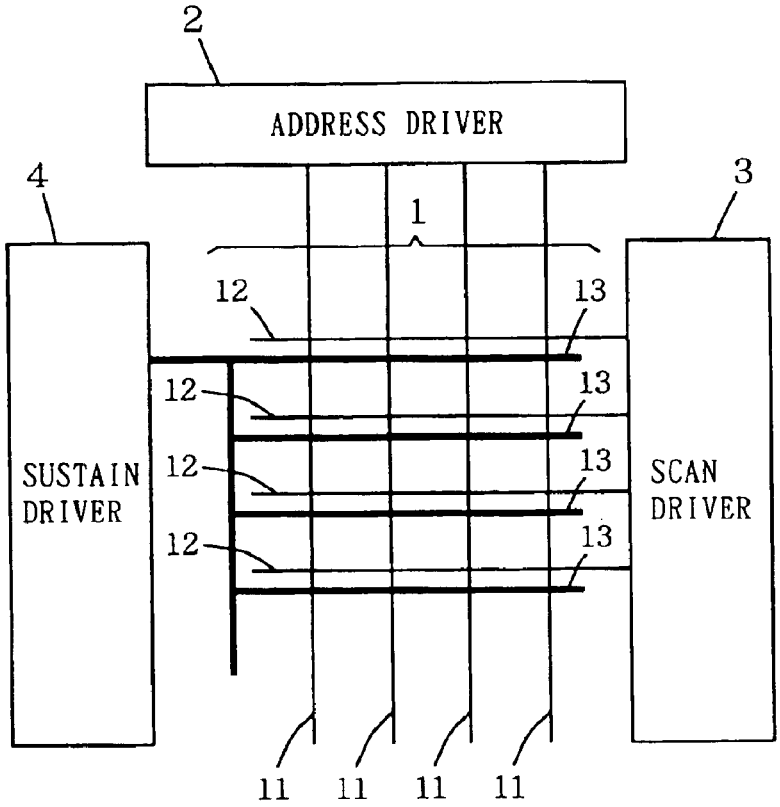
FIG. 18 is a schematic view mainly showing the configuration of a PDP in a conventional plasma display device.
Figure 19:
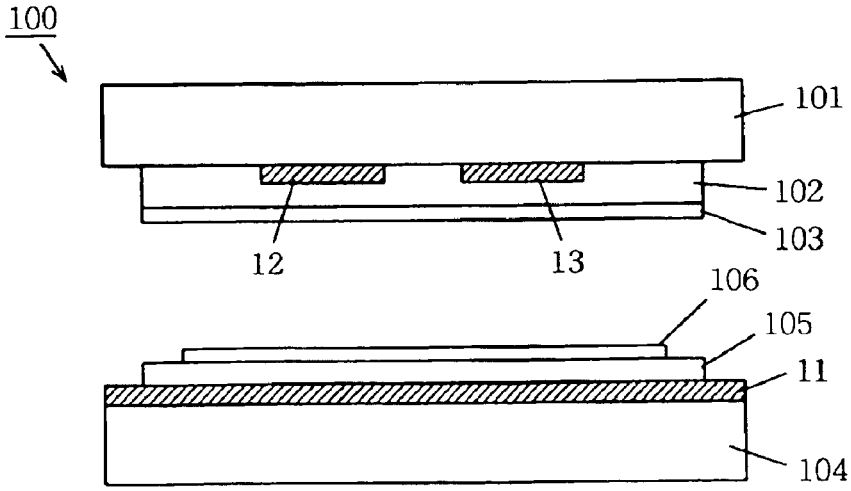
FIG. 19 is a schematic sectional view of a three-electrode surface discharge cell in the AC PDP.
Figure 20:
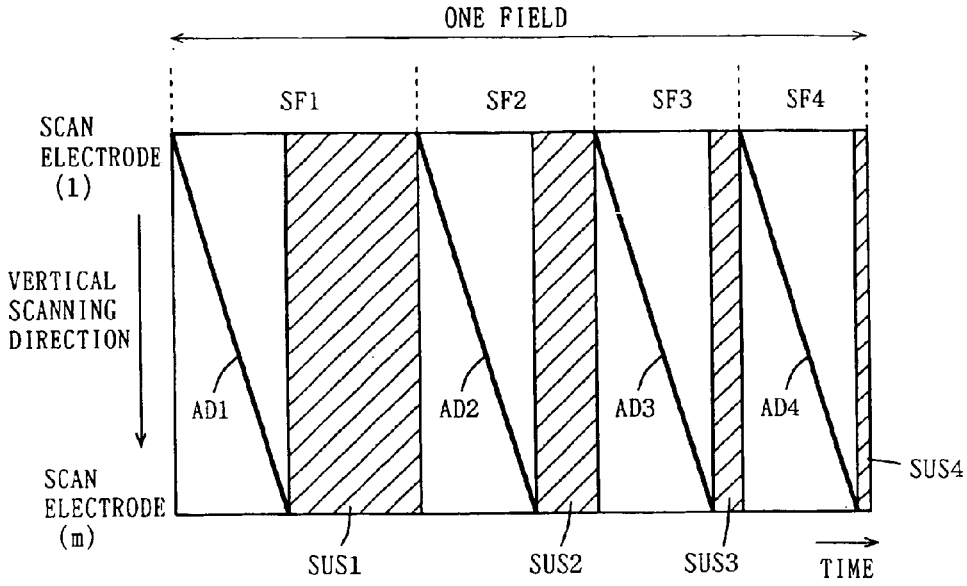
FIG. 20 is a diagram for explaining an ADS system.
Figure 21:
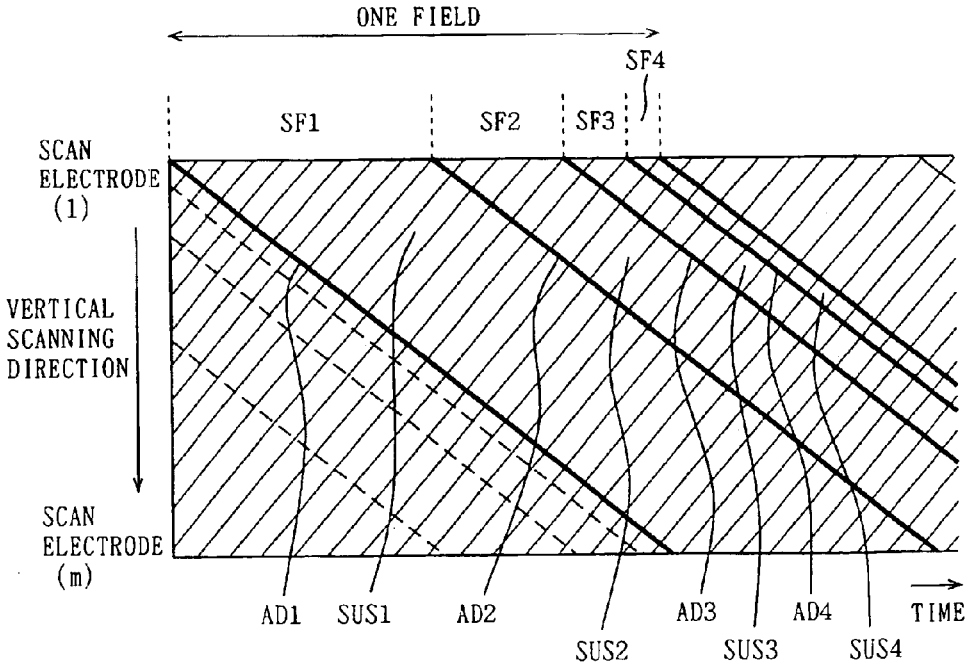
FIG. 21 is a diagram for explaining an address-while-display scheme.

FIG. 14 is a block diagram mainly showing the configurations of a scan driver and a discharge control timing generating circuit in a plasma display device according to a fourth embodiment of the present invention. FIG. 15 is a signal waveform diagram showing an example of the operations of the scan driver and the discharge control timing generating circuit shown in FIG. 14. Further, FIG. 16 is a waveform diagram showing voltages for driving a scan electrode and a sustain electrode which correspond to one line.

In the plasma display device in the present embodiment, the PDP 1 shown in FIG. 2 is used.

In FIG. 14, a scan driver 3B comprises two shift registers 310 and 320, a plurality of phase inverting circuits 350 corresponding to a plurality of scan electrodes 12, and an output circuit 340. Each of the shift registers 310 and 320 has a plurality of output terminals corresponding to the plurality of scan electrodes 12. The phase inverting circuit 350 comprises a judging circuit 351, OR gates 352 and 353, and an AND gate 354. The output circuit 340 comprises a plurality of output drivers 341 respectively connected to the plurality of scan electrodes 12.

The scan pulse generating circuit 501 feeds a discharge control timing signal PSC having a write pulse Pw, a sustain pulse Psc, an erase pulse Pe, and a suspended pulse Pr to the shift register 310 in the scan driver 3B, and feeds a sustain period pulse signal PH representing a sustain period to the shift register 320. The sustain pulse generating circuit 502 feeds a discharge control timing signal SU having a sustain pulse Psu to the sustain register 4 shown in FIGS. 1 and 2.

The shift register 310 in the scan driver 3B successively feeds the discharge control timing signal PSC to respective one input terminals of the OR gates 352 in the plurality of phase inverting circuits 351 while shifting the discharge control timing signal PSC. Further, the shift register 320 successively feeds the sustain period pulse signal PH to the respective judging circuits 351 in the plurality of phase inverting circuits 350 while shifting the sustain period pulse signal PH.

To the judging circuits 351 in the plurality of phase inverting circuits 350, data A1 to Am for each sub-field on corresponding lines are respectively fed from the sub-field converter 8 shown in FIG. 1. Each of the data indicates whether or not a plurality of corresponding discharge cells emit light in the corresponding sub-field.

The judging circuit 351 judges, on the basis of the sustain period pulse signal PH on the corresponding line and the data for each sub-field on the corresponding line, whether or not all of the discharge cells or the discharge cells whose number is not less than a predetermined number do not emit light in the sub-field, and feeds a judgment signal HST representing the result of the judgment to the other input terminal of the OR gate 352 and feeds an inverted signal of the judgment signal HST to one input terminal of the OR gate 353. The discharge control timing signal SU is fed from the sustain pulse generating circuit 502 to the other input terminal of the OR gate 353.

The OR gate 352 outputs a discharge control timing signal QSC on the basis of the discharge control timing signal PSC and the judgment signal HST. The OR gate 353 outputs a discharge control timing signal QSU on the basis of the judgement signal HST and the discharge control timing signal SU. The AND gate 354 feeds a discharge control timing signal SC to the corresponding output driver 341 in the output circuit 340 on the basis of the discharge control timing signal QSC and the discharge control timing signal QSU. Consequently, the scan electrode 12 connected to the output driver 341 is driven.

In the present embodiment, the scan driver 3B corresponds to a pulse applying circuit, and the judging circuit 351 correspond to a judging circuit.

FIG. 15 illustrates discharge control timing signals PSC, SU, QSC, QSU, and SC, a sustain period pulse signal PH, and a judgement signal HST which correspond to one line. In FIG. 15, a latticed pattern and a hatched pattern in each of the discharge control timing signals PSC, SU, QSC, QSU, and SC respectively mean pulses which are shifted 180° from each other.

The phase of the discharge control timing signals PSC and SC and the phase of the discharge control timing signal SU are generally shifted 180° from each other in a sustain period. On the other hand, the phase of the discharge control timing signals PSC and SC and the phase of the discharge control timing signal SU coincide with each other in a suspended period.

The sustain period pulse signal PH enters a high level in the sustain period in each of sub-fields SF1 to SF4, while entering a low level in the suspended period. The judgment signal HST enters a high level when all of the discharge cells on each of the lines or the discharge cells whose number is not less than the predetermined number do not emit light for each of the sub-fields on the line, while entering a low level in the other case.

In the example shown in FIG. 15, in the sub-field SF3, the judgment signal HST enters a high level. Consequently, the discharge control timing signal QSC enters a high level, so that the phase of the discharge control timing signal QSU is equal to the phase of the discharge control timing signal SU. As a result, the phase of the discharge control timing signal SC is equal to the phase of the discharge control timing signal SU.

As shown in FIG. 16, in the sustain period in the sub-field SF3, the phase of pulses Ps applied to the scan electrode 12 is equal to the phase of sustain pulses Psu applied to the sustain electrode 13.

It is thus judged whether or not all of the discharge cells on each of the lines or the discharge cells whose number is not less than the predetermined number do not emit light for each of the sub-fields on the line. When all of the discharge cells or the discharge cells whose number is not less than the predetermined number do not emit light, the phase of the pulses Ps applied to the corresponding scan electrode 12 in the sustain period in the sub-field on the line is equal to the phase of the sustain pulses Psu applied to the sustain electrode 13. Consequently, a potential difference between the scan electrode 12 and the sustain electrode 13 is kept constant, so that charge or discharge currents in the scan electrodes 12 and the sustain electrode 13 are reduced. As a result, power consumption in the plasma display device is reduced.

In the plasma display device according to the fourth embodiment, the sustain pulses Psu are always applied to the sustain electrode 13 in a predetermined period. Accordingly, it is possible to use the PDP 1 to which the sustain electrodes 13 shown in FIG. 2 are together connected.

According to the display device and the method of driving the same in the present invention, when all of the plurality of discharge cells connected to each of the second electrodes or the discharge cells whose number is not less than the predetermined number do not emit light in the light emission period in each of the fields set for the second electrode, at least one of the second electrode and a corresponding first electrode is kept at the predetermined level in the light emission period. Accordingly, the charge or discharge current in at least one of the first and second electrodes is reduced, and the generation of electromagnetic waves is reduced. As a result, power consumption in the display device is reduced, and electromagnetic interference is prevented from occurring.

When all of the plurality of discharge cells connected to each of the second electrodes or the discharge cells whose number is not less than the predetermined number do not emit light in the light emission period in each of the fields set for the second electrode, a pulse voltage having the same phase as that of the first pulse voltage is periodically applied in place of the second pulse voltage to the second electrode in the light emission period. Accordingly, a potential difference between the first and second electrodes is kept constant, so that the charge or discharge currents in the first and second electrodes are reduced. As a result, power consumption in the display device is reduced.

What is claimed is:

1. A display device comprising:

a plurality of first electrodes arranged in a first direction;

a plurality of second electrodes arranged in said first direction so as to be paired with said plurality of first electrodes respectively;

a plurality of third electrodes arranged in a second direction crossing said first direction;

a plurality of discharge cells provided at the intersections of said plurality of first electrodes, said plurality of second electrodes, and said plurality of third electrodes;

a first voltage applying circuit for periodically applying a first pulse voltage to each of the first electrodes;

a second voltage applying circuit for periodically applying, in a light emission period in each of fields set for each of the second electrodes, a second pulse voltage having a phase different from that of said first pulse voltage to the second electrode; and a voltage holding circuit for holding, when all of the plurality of discharge cells on each of a line connected to the second electrodes do not emit light in a light emission period in each of the fields set for the second electrode, the voltages of the second electrode and the corresponding first electrode on the line at the same level in the light emission period.

2. The display device according to claim 1, wherein said same level is a ground potential.

3. The display device according to claim 1, wherein each of said plurality of discharge cells is a three-electrode surface discharge cell constituting a plasma display panel.

4. A method of driving a display device comprising a plurality of first electrodes arranged in a first direction, a plurality of second electrodes arranged in said first direction so as to be paired with said plurality of first electrodes respectively, a plurality of third electrodes arranged in a second direction crossing said first direction, and a plurality of discharge cells provided at the intersections of said plurality of first electrodes, said plurality of second electrodes, and said plurality of third electrodes; comprising the steps of:

periodically applying a first pulse voltage to each of the first electrodes;

periodically applying, in a light emission period in each of fields set for each of the second electrodes, a second pulse voltage having a phase different from that of said first pulse voltage to the second electrode; and keeping, when all of the plurality of discharge cells on each of a line connected to the second electrodes do not emit light in the light emission period in each of the fields set for the second electrode, the voltages of the second electrode and the corresponding first electrode on the line at the same level in the light emission period.

5. A display device comprising:

a plurality of first electrodes arranged in a first direction;

a plurality of second electrodes arranged in said first direction so as to be paired with said plurality of first electrodes respectively;

a plurality of third electrodes arranged in a second direction crossing said first direction;

a plurality of discharge cells provided at the intersections of said plurality of first electrodes, said plurality of second electrodes, and said plurality of third electrodes;

a first voltage applying circuit for periodically applying a first pulse voltage to each of the first electrodes;

a second voltage applying circuit for periodically applying, in a light emission period in each of fields set for each of the second electrodes, a second pulse voltage having a phase different from that of said first pulse voltage to the second electrode; and a voltage holding circuit for holding, when discharge cells on each of a line whose number is not less than a predetermined number do not emit light in a light emission period in each of the fields set for the second electrode, the voltages of the second electrode and the corresponding first electrode on the line at the same level in the light emission period.

6. A method of driving a display device comprising a plurality of first electrodes arranged in a first direction, a plurality of second electrodes arranged in said first direction so as to be paired with said plurality of first electrodes respectively, a plurality of third electrodes arranged in a second direction crossing said first direction, and a plurality of discharge cells provided at the intersections of said plurality of first electrodes, said plurality of second electrodes, and said plurality of third electrodes; comprising the steps of:

periodically applying a first pulse voltage to each of the first electrodes;

periodically applying, in a light emission period in each of fields set for each of the second electrodes, a second pulse voltage having a phase different from that of said first pulse voltage to the second electrode; and keeping, when discharge cells on each of a line whose number is not less than a predetermined number do not emit light in the light emission period in each of the fields set for the second electrode, the voltages of the second electrode and the corresponding first electrode on the line at the same level in the light emission period.

* * * * *